US011240613B2

(12) United States Patent
Bjorn et al.

(10) Patent No.: US 11,240,613 B2
(45) Date of Patent: Feb. 1, 2022

(54) BONE CONDUCTION IMPLANT

(71) Applicant: Cochlear Limited, Macquarie University (AU)

(72) Inventors: Goran Bjorn, Onsala (SE); Marcus Andersson, Göteborq (SE); Stefan Magnander, Göteborq (SE); Stellan Johansson, Kunqälv (SE)

(73) Assignee: Cochlear Limited, Macquarie University (AU)

( * ) Notice: Subject to any disclaimer, the term of this patent is extended or adjusted under 35 U.S.C. 154(b) by 1823 days.

(21) Appl. No.: 14/543,327

(22) Filed: Nov. 17, 2014

(65) Prior Publication Data

US 2015/0215696 A1 Jul. 30, 2015

Related U.S. Application Data

(60) Provisional application No. 61/933,795, filed on Jan. 30, 2014.

(51) Int. Cl.
*H04R 25/00* (2006.01)

(52) U.S. Cl.
CPC ..... *H04R 25/606* (2013.01); *H04R 2460/13* (2013.01)

(58) Field of Classification Search
CPC . A61B 17/863; A61B 17/8625; A61B 17/866; A61B 17/8655; A61C 8/0012–0015; H04R 25/606; H04R 2460/13
See application file for complete search history.

(56) References Cited

U.S. PATENT DOCUMENTS

| | | | |
|---|---|---|---|
| 2,016,610 | A | 10/1935 | Moeller |
| 4,025,964 | A | 5/1977 | Owens |
| 4,498,461 | A | 2/1985 | Hakansson |
| D294,295 | S | 2/1988 | Branemark |
| 4,738,623 | A | 4/1988 | Driskell |
| 4,904,233 | A | 2/1990 | Hakansson et al. |
| 4,917,555 | A | 4/1990 | Taubert |
| 4,936,317 | A | 6/1990 | MacGregor |
| 4,998,461 | A | 3/1991 | Ishiwata et al. |
| 5,135,395 | A | 8/1992 | Marlin |
| 5,269,685 | A | 12/1993 | Jornéus et al. |

(Continued)

FOREIGN PATENT DOCUMENTS

| | | | |
|---|---|---|---|
| EP | 0996391 | B1 | 2/2004 |
| KR | 1020120000235 | A | 1/2012 |

(Continued)

OTHER PUBLICATIONS

Mats Thomsson et al., "A retrospective case series evaluating Branemark BioHelix implants placed in a specialis private practice following 'conventional' procedures. One-year results after placement," Eur J Oral Implantol., Oct. 2008, pp. 229-234, vol. 1, No. 3.

(Continued)

*Primary Examiner* — Catherine B Kuhlman
(74) *Attorney, Agent, or Firm* — Pilloff Passino & Cosenza LLP; Martin J. Cosenza

(57) ABSTRACT

An apparatus for a bone conduction implant, comprising a bone fixture including a screw thread configured to screw into a skull, wherein at least a section of the screw thread is non-uniform.

10 Claims, 39 Drawing Sheets

(56) References Cited

U.S. PATENT DOCUMENTS 5,588,883 A 12/1996 Hattori
5,628,630 A * 5/1997 Misch ..... A61C 8/0022 411/308
5,653,710 A 8/1997 Harle
5,735,790 A 4/1998 Hakansson et al.
5,769,630 A 6/1998 Hoffman
5,829,978 A * 11/1998 Day ..... A61C 8/0012 433/174
5,833,463 A 11/1998 Hurson
5,868,749 A * 2/1999 Reed ..... A61B 17/80 606/104
5,961,329 A 10/1999 Stucki-McCormick
6,030,162 A 2/2000 Huebner
6,086,303 A 7/2000 Fluckiger
6,102,703 A * 8/2000 Day ..... A61C 8/0006 433/173
6,129,730 A * 10/2000 Bono ..... A61B 17/8047 606/271
6,474,991 B1 11/2002 Hansson
6,604,945 B1 8/2003 Jones
6,643,378 B2 11/2003 Schumaier
6,669,701 B2 12/2003 Steiner et al.
6,699,250 B1 * 3/2004 Osterle ..... A61B 17/8625 606/311
6,840,919 B1 1/2005 Hakansson
6,896,517 B1 5/2005 Bjorn et al.
6,953,463 B2 10/2005 West, Jr.
7,065,223 B2 6/2006 Westerkull
7,074,222 B2 7/2006 Westerkull
7,771,774 B2 * 8/2010 Berckmans, III .... A61B 17/866 427/2.1
7,806,693 B2 10/2010 Hurson
D634,186 S 3/2011 Kemper
8,016,593 B2 9/2011 Hall
8,170,252 B2 5/2012 Parker et al.
2003/0176866 A1 9/2003 Westerkull
2004/0032962 A1 2/2004 Westerkull
2004/0152047 A1 8/2004 Odrich et al.
2004/0210103 A1 10/2004 Westerkull
2004/0228705 A1 11/2004 Baer et al.
2005/0106534 A1 5/2005 Gahlert
2005/0153261 A1 7/2005 Chang
2005/0248158 A1 11/2005 Westerkull
2005/0249366 A1 11/2005 Westerkull
2005/0250074 A1 11/2005 Lang et al.
2005/0287497 A1 12/2005 Carter
2006/0050913 A1 3/2006 Westerkull
2006/0056649 A1 3/2006 Schumaier
2006/0093175 A1 * 5/2006 Westerkull ..... H04R 25/606 381/326
2006/0126874 A1 6/2006 Westerkull
2006/0172257 A1 8/2006 Niznick
2006/0195099 A1 8/2006 Bottlang
2006/0211910 A1 9/2006 Westerkull
2007/0009853 A1 1/2007 Pitulia
2007/0053536 A1 3/2007 Westerkull
2007/0059666 A1 3/2007 Zickman et al.
2007/0147973 A1 * 6/2007 Laan ..... F16B 5/0275 411/411
2008/0032264 A1 * 2/2008 Hall ..... A61C 8/0022 433/174
2008/0091208 A1 * 4/2008 Hansson ..... A61B 17/863 606/80
2008/0125868 A1 * 5/2008 Branemark ..... A61B 17/866 623/23.57
2009/0023109 A1 1/2009 Jinton et al.
2009/0082817 A1 3/2009 Jinton et al.
2010/0092920 A1 * 4/2010 Hsieh ..... A61C 8/0022 433/174
2010/0240010 A1 * 9/2010 Holmstrom ..... A61C 8/0022 433/174
2010/0249784 A1 9/2010 Andersson
2010/0286776 A1 * 11/2010 Andersson ..... A61L 27/54 623/16.11
2011/0195380 A1 8/2011 Giorno
2012/0143251 A1 6/2012 Green et al.
2015/0215696 A1 7/2015 Bjorn et al.

FOREIGN PATENT DOCUMENTS

SE 531177 C2 1/2009
WO 9205745 A1 4/1992
WO 9619950 A1 7/1996
WO 9855049 A1 12/1998
WO 9923971 A1 5/1999
WO 0193634 A1 12/2001
WO 0193645 A1 12/2001
WO 0209622 A1 2/2002
WO 2004012622 A1 2/2004
WO 2004045432 A1 6/2004
WO 2004058091 A1 7/2004
WO 2004093401 A1 10/2004
WO 2004098442 A1 11/2004
WO 2004105650 A1 12/2004
WO 2005000391 A1 1/2005
WO 2006052527 A2 5/2006
WO 2009015102 A1 1/2009
WO 2009015103 A1 1/2009

OTHER PUBLICATIONS

International Search Report and Written Opinion for PCT/IB2015/050733, dated May 8, 2015.
Extended European Search Report for EP Patent No. 3 100 469, dated Jul. 18, 2017.
Sjostrom et al., "Monitoring of implant stability in grafted bone using resonance frequency analysis—A clinical study from implant placement to 6 months of loading", Jan. 2005, pp. 45-51, vol. 34, issue 1.
http://www.merriam-webster.com/dictionary/tapered, Retrieved Apr. 10, 2012.
http://www.merriam-webster.com/dictionary/apical, Retrieved Apr. 10, 2012.
http://www.merriam-webster.com/dictionary/portion, Retrieved Apr. 10, 2012.

* cited by examiner

BONE CONDUCTION IMPLANT

CROSS-REFERENCE TO RELATED APPLICATIONS

This application claims priority to Provisional U.S. Patent Application No. 61/933,795, entitled BONE CONDUCTION IMPLANT, filed on Jan. 30, 2014, naming Goran BJORN of Molnlycke, Sweden, as an inventor, the entire contents of that application being incorporated herein by reference in its entirety.

BACKGROUND

Field of the Invention

Some embodiments relate generally to prostheses and, more particularly, to a prosthesis having a bone fixture.

Related Art

For persons who cannot benefit from traditional acoustic hearing aids, there are other types of commercially available hearing prostheses such as, for example, bone conduction hearing prostheses (commonly referred to as "bone conduction devices"). Bone conduction devices mechanically transmit sound information to a recipient's cochlea by transferring vibrations to a person's skull. This enables the hearing prosthesis to be effective regardless of whether there is disease or damage in the middle ear.

Traditionally, bone conduction devices transfer vibrations from an external vibrator to the skull through a bone conduction implant that penetrates the skin and is physically attached to both the vibrator and the skull. Typically, the external vibrator is connected to the percutaneous bone conduction implant located behind the outer ear facilitating the efficient transfer of sound via the skull to the cochlea. The bone conduction implant connecting the vibrator to the skull generally comprises two components: a bone attachment piece (e.g., bone fixture/fixture) that is attached or implanted directly to the skull, and a skin penetrating piece attached to the bone attachment piece, commonly referred to as an abutment.

SUMMARY

In one embodiment, there is a bone fixture including a screw thread configured to screw into a skull, wherein at least a portion of a section of the screw thread that extends at least a portion of the way along the helix of the thread is non-uniform.

In another embodiment, there is an apparatus for a bone conduction implant, comprising a bone fixture including a screw thread configured to screw into a skull, wherein at least a portion of the screw thread includes a porous-solid scaffold configured to promote growth of the recipient's skull bone.

In another embodiment, there is an apparatus for a bone conduction implant, comprising a bone fixture including a threaded section, wherein an outer profile of the threaded section is non-uniform.

In another embodiment, there is an apparatus for a bone conduction implant, comprising a bone fixture including a screw thread section configured to screw into a skull and at least one of a flange section configured to abut an outer surface of the skull and limit an insertion depth of the bone fixture, wherein at least an outer portion of the flange includes a surface discontinuity; or a tip having at least one of a hollow inner portion open to an outside of the bone fixture or a conical outer portion.

BRIEF DESCRIPTION OF THE DRAWINGS

Embodiments of the present invention are described herein with reference to the attached drawing sheets in which.

DETAILED DESCRIPTION

Figure 1:
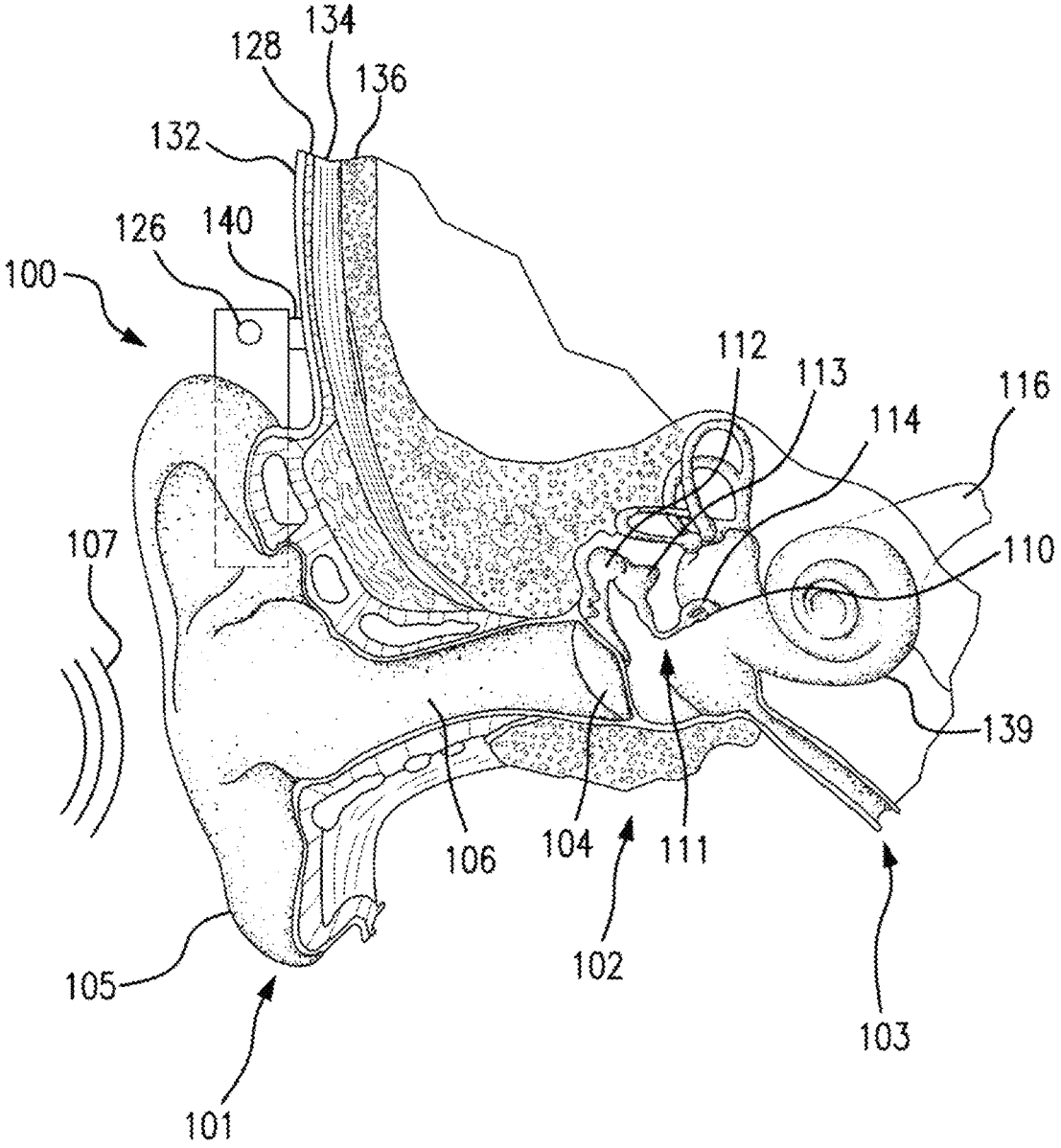
FIG. 1 is a perspective view of a percutaneous bone conduction device in which embodiments of the present invention may be implemented.

FIG. 1 is a perspective view of a bone conduction device 100 in which embodiments of the present invention can be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient and comprises a sound input element 126 to receive sound signals. Sound input element can comprise, for example, a microphone, telecoil, etc. In an exemplary embodiment, sound input element 126 can be located, for example, on or in bone conduction device 100, or on a cable extending from bone conduction device 100.

In an exemplary embodiment, bone conduction device 100 comprises an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100. Such releasable coupling is accomplished via a coupling apparatus of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a vibrator, corresponding to a genus of which these are species of) and/or various other operational components, such as sound input device 126. In this regard, the operationally removable component is sometimes referred to herein as a vibrator unit. More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull. It is noted that in some embodiments, the operationally removable component is a vibration sensor. In this regard, the operationally removable component can be a transducer, which is a genus that includes at least the species vibration sensor and vibrator.

As illustrated, the operationally removable component of the bone conduction device 100 further includes a coupling apparatus 140 configured to operationally removably attach the operationally removable component to a bone conduction implant (also referred to as an anchor system and/or a fixation system) which is implanted in the recipient. In the embodiment of FIG. 1, coupling apparatus 140 is coupled to the bone conduction implant (not shown) implanted in the recipient in a manner that is further detailed below with respect to exemplary embodiments of the bone conduction implant. Briefly, now with reference to FIG. 2A, an exemplary bone conduction implant 201 can include a percutaneous abutment attached to a bone fixture via a screw, the bone fixture being fixed to the recipient's skull bone 136. The abutment extends from the bone fixture which is screwed into bone 136, through muscle 134, fat 128 and skin 132 so that the coupling apparatus can be attached thereto. Such a percutaneous abutment provides an attachment location for the coupling apparatus that facilitates efficient transmission of mechanical force.

Figure 2:
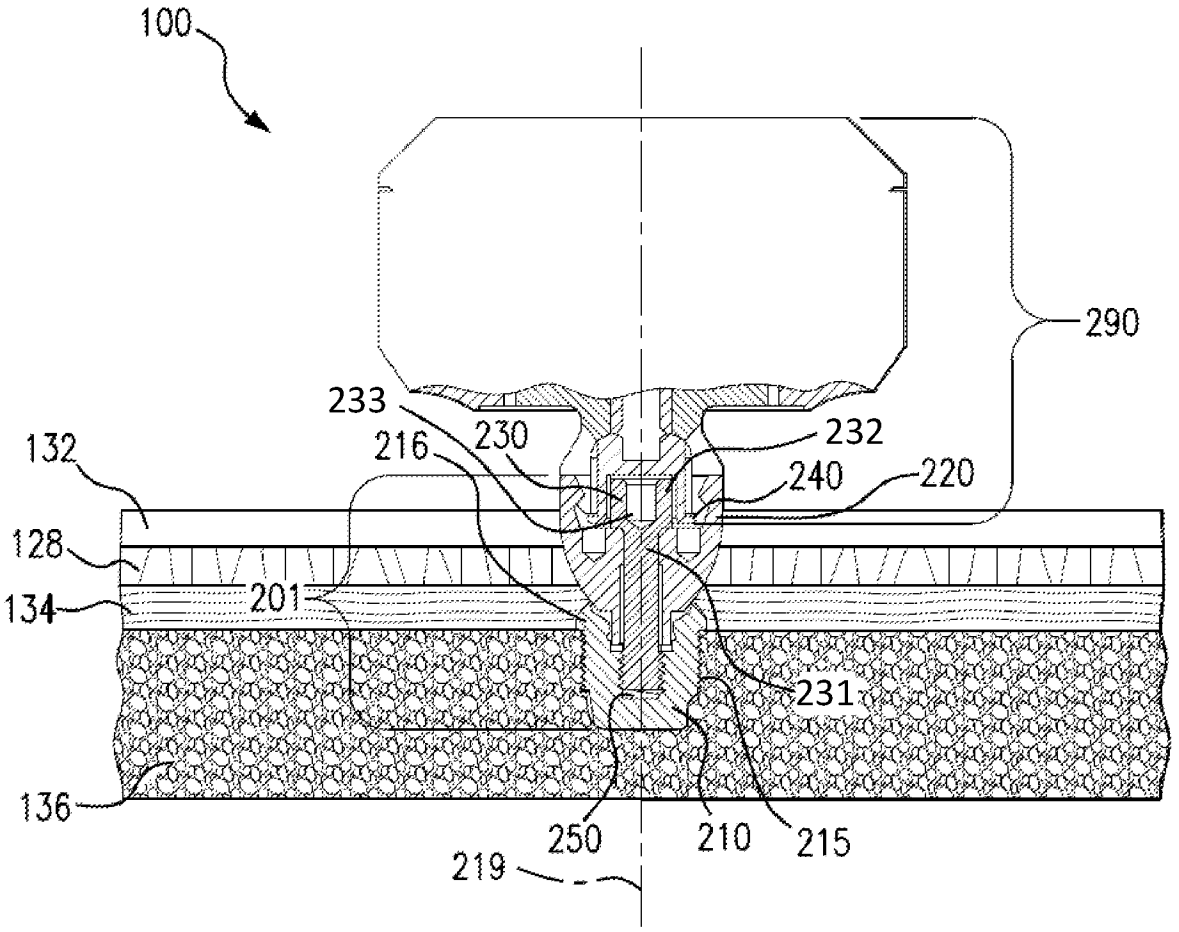
FIG. 2 depicts a more detailed view of the bone conduction device of FIG. 1.

FIG. 2 depicts additional details of the bone conduction device 100. More particularly, the bone conduction device 100 is shown as including operationally removable component 290 vibrationally connected to and removably coupled to an exemplary bone conduction implant 201 via coupling apparatus 140 (corresponding to coupling apparatus 240) thereof. More particularly, operationally removable component 290 includes a vibrator (not shown) that is in vibrational communication to coupling apparatus 240 such that vibrations generated by the vibrator in response to a sound captured by sound capture device 126 are transmitted to coupling apparatus 240 and then to bone conduction implant 201 in a manner that at evokes hearing percept.

Bone conduction implant 201 includes a bone fixture 210 configured to screw into the skull bone 136, a skin-penetrating abutment 220 and an abutment screw 230 that includes an elongate coupling shaft 231 and a head 232 with a hollow portion 233. As may be seen, the abutment screw 230 connects and holds the abutment 220 to the fixture 210, thereby rigidly attaching abutment 220 to bone fixture 210. The rigid attachment is such that the abutment is vibrationally connected to the fixture 210 such that at least some of the vibrational energy transmitted to the abutment is transmitted to the fixture in a sufficient manner to effectively evoke a hearing percept.

Some exemplary features of the bone fixture 210 will now be described.

Bone fixture 210 (hereinafter sometimes referred to as fixture 210) can be made of any material that has a known ability to integrate into surrounding bone tissue (i.e., it is made of a material that exhibits acceptable osseointegration characteristics). In one embodiment, fixture 210 is formed from a single piece of material (it is a monolithic component) and has a main body. In an embodiment, the fixture 210 is made of titanium. The main body of bone fixture 210 includes outer screw thread 215 forming a male screw which is configured to be installed into the skull 136. Fixture 210 also comprises a flange 216 configured to function as a stop when fixture 210 is installed into the skull. Owing to the bottom surface of the flange (the part that contacts the top surface of the bone), flange 216 prevents the bone fixture 210 in general, and, in particular, screw threads 215, from potentially completely penetrating through the skull. Fixture 210 can further comprise a tool-engaging socket having an internal grip section for easy lifting and handling of fixture 210, as will be described in further detail below. An exemplary tool-engaging socket is described and illustrated in U.S. Provisional Application No. 60/951,163, entitled "Bone Anchor Fixture for a Medical Prosthesis," filed Jul. 20, 2007, by Applicants Lars Jinton, Erik Holgersson and Peter Elmberg which, in some embodiments, can be used exactly as detailed therein and/or in a modified form, to install and manipulate the bone fixture 210.

The body of fixture 210 can have a length sufficient to securely anchor the fixture 210 to the skull without penetrating entirely through the skull bone. The length of the body can therefore depend on the thickness of the skull at the implantation site. Some exemplary lengths are detailed below.

The distal region of fixture 210 can also be fitted with self-tapping cutting edges (e.g., three edges) formed into the exterior surface of the fixture 210. Further details of the self-tapping features are described in International Patent Application Publication WO 02/09622, and can be used with some embodiments of bone fixtures exactly as detailed therein and/or in a modified form, to configure the fixtures detailed herein to be installed into a skull.

As illustrated in FIG. 2, flange 216 has a substantially planar bottom surface for resting against the outer bone surface, when bone fixture 210 has been screwed down into the skull. Flange 216 can have a diameter which exceeds the peak diameter (maximum diameter) of the screw threads 215 (the screw threads 215 of the fixture 210 can have a maximum diameter of about 3.5 to about 5.0 mm). In one embodiment, the diameter of the flange 216 exceeds the peak diameter of the screw threads 215 by approximately 10-20%. Although flange 216 is illustrated in FIG. 2 as being circular, flange 216 can be configured in a variety of shapes so long as flange 216 has at least one of a diameter or width that is greater than the peak diameter of the screw threads 215. Also, the size of flange 216 can vary depending on the particular application for which the bone conduction implant 201 is intended.

In an exemplary embodiment, the flange 216 can be in the form of a protruding or recessed hex or other multi-lobs geometry instead of being circular. That is, flange 216 can have a hexagonal cross-section that lies on a plane normal to the longitudinal axis 219 of the bone fixture 220/bone conduction implant 201 such that a female hex-head socket wrench can be used to apply torque to the bone fixture 210. However, in the embodiment illustrated in FIG. 2, the flange 216 has a smooth, upper end that has a circular cross-section that lies on the aforementioned plane, and thus does not have a protruding hex. The smooth upper end of the flange 216 and the absence of any sharp corners provides for improved soft tissue adaptation. As mentioned above, flange 216 also comprises a cylindrical part which, together with the flared upper part, provides sufficient height in the longitudinal direction for connection with the abutment 220.

It is noted that the bone fixture depicted in FIG. 2 and the following FIGS. are exemplary. Any bone fixture of any type, size/having any geometry can be used in some embodiments providing that the bone fixture permits embodiments as detailed herein and variations thereof to be practiced.

Some exemplary bone fixtures that correspond to bone fixture 210 will now be described.

Figure 3A:
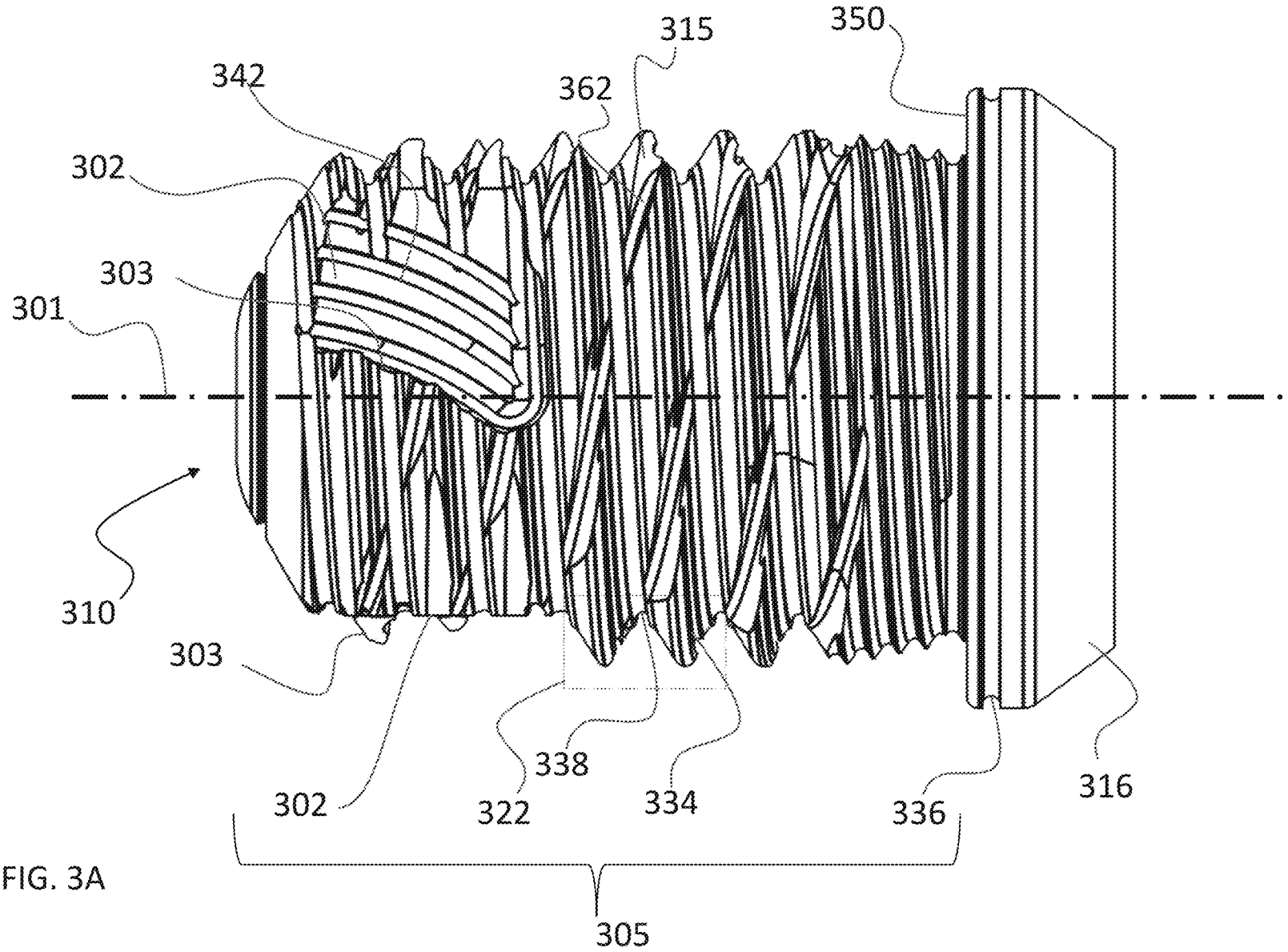
FIG. 3A depicts a side view of an exemplary bone fixture according to an exemplary embodiment.
Figure 3B:
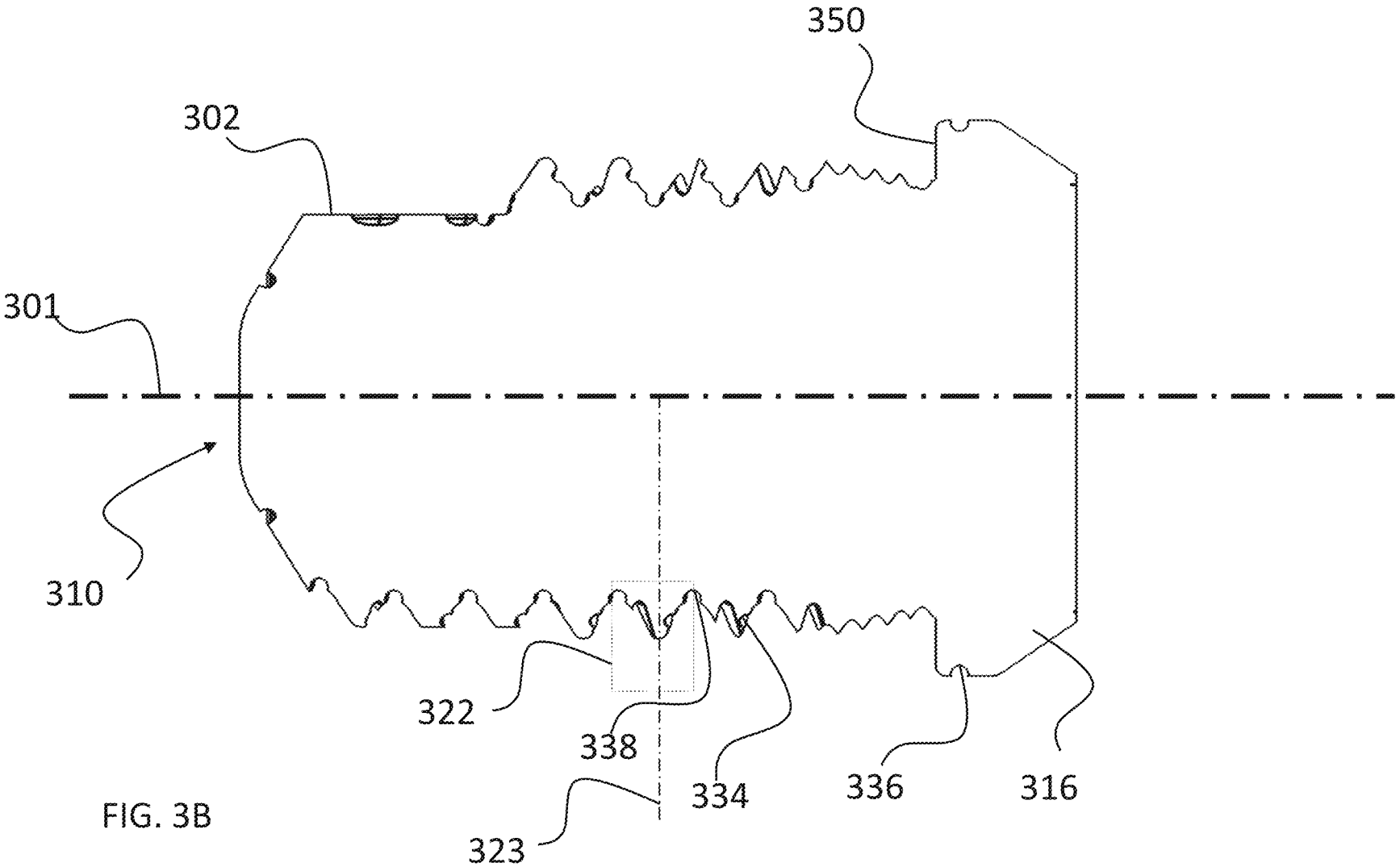
FIG. 3B depicts a cross-sectional view of the exemplary bone fixture of FIG. 3A.

FIGS. 3A and 3B depict an exemplary embodiment of a bone fixture 310. FIG. 3B is a cross-section through the bone fixture 310 of FIG. 3A on a plane lying on the longitudinal 301 axis thereof except at an angle relative to the plane of FIG. 3A (note the flat area 302 of FIG. 3B relative to that same area in FIG. 3A—discussed in greater detail below). In an exemplary embodiment, bone fixture 310 corresponds to bone fixture 210 of FIG. 2. Bone fixture 310 includes a screw thread 315 configured to screw into a skull, corresponding to thread 215 of FIG. 2. In an exemplary embodiment, the pitch of the screw thread 315 is between about 0.2 to about 1.00 mm or any value or range of values therebetween in about 0.01 mm increments (e.g., about 0.3 to about 0.8 mm). In an exemplary embodiment, the depth of the thread is between about 0.1 to about 1.25 mm or any value or range of values therebetween in about zero 0.1 mm increments (e.g., about 0.25 to about 0.8 mm).

In the embodiment of FIGS. 3A-3B, a portion of the section of the screw thread that extends at least a portion of the way along the helix of the thread is non-uniform. By "section," it is meant the thread from tip to root.

Figure 3C:
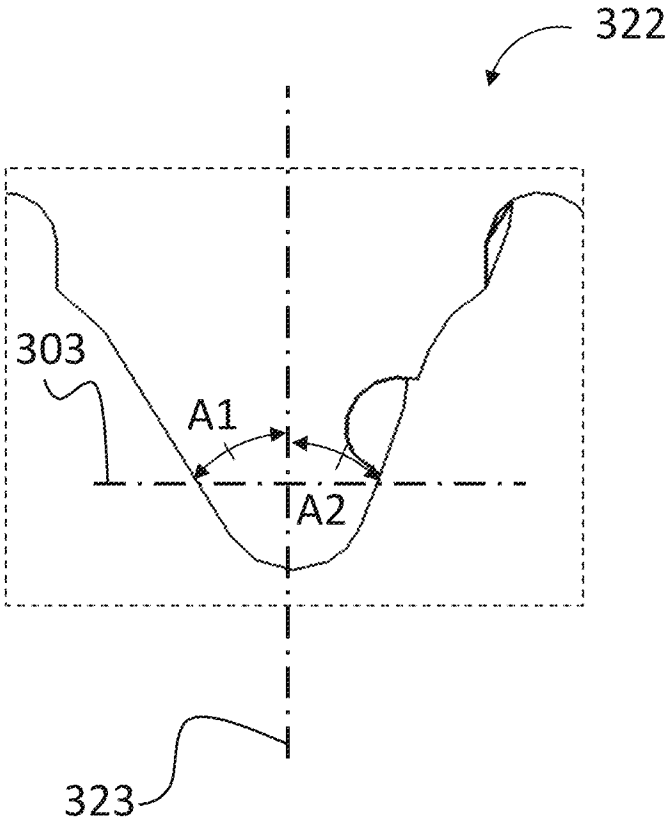
FIG. 3C depicts a portion of the cross-sectional view of FIG. 3A.

In an exemplary embodiment, bone fixture 310 has a section 322 having such non-uniformity. FIG. 3C depicts a close-up view of section 322. As can be seen, the thread angle of the section is asymmetrical. Specifically, one face of the thread extends at angle A1, which is a 30 degree angle from the centerline 323 of the thread section 322 (i.e., the line that is normal to the longitudinal axis of the helix of the thread), and another face of the thread extends at an angle A2, which is a 20 degree angle from the centerline of the thread section. It is noted that in this embodiment, the angles are measured from the centerline 323 to a portion of the thread that is flat. That is, the angles are not measured from a tangent plane on a rounded surface.

It is noted that in an alternate embodiment, the faces of the thread can be compound faces. That is, for example, one face of the thread may have a first surface that extends at a first angle from the centerline 323, and a second surface that extends at a second angle from the centerline 323 different from the first angle. In some instances, both faces of the thread may have such compound surfaces. Accordingly, in some embodiments, the aforementioned angles are measured from a location on the faces that corresponds to the same distance from the longitudinal axis 301 of the bone fixture 310/measured on a plane that is normal to the direction of centerline 323, as is exemplary depicted by line 303 in FIG. 3C, which is parallel to longitudinal axis 301 (thereby establishing an "apples to apples" comparison).

That said, in an alternate embodiment, the aforementioned angles are mean average angles. That is, the angles can be measured from a statistical location in space based on the faces of the thread. In this regard, again referring back to the compound faces noted above, a portion of the thread can extend at a first angle relative to the centerline 323, and another section of thread can extend that a second angle, different from the first angle, relative to the centerline 323. The average angle can be a weighted angle between the two angles (weighted based on the length of extension, for example). Thus, if a face extends for unit of length at an angle of 30 degrees, and extends for two units of length at an angle of 40 degrees, the mean average would be 36.67 degrees.

Also, in some embodiments, as will be detail below, the faces of the threads can have portions that are not flat (e.g., as detailed below, and as can be seen in FIG. 3C, some threads have grooves therein). Accordingly, in an exemplary embodiment, the aforementioned angles can be measured from extrapolated flat surfaces, at least with respect to the average angles.

In an exemplary embodiment, angle A1 and angle A2 can be any angle having a difference from each other in a range from about 1 degree to about 45 degrees or any value or range of values therebetween in 0.1 degree increments. Accordingly, the asymmetrical nature of the threads can correspond to many forms, and at least some embodiments can include any of these at various forms and/or variations thereof.

It is noted that in at least some exemplary embodiments having the asymmetrical thread profile, the asymmetrical thread profile enables a relative increase in the thread revolutions of the bone fixture, for a given length, relative to that which would be the case with a non-asymmetrical thread profile/uniform thread profile. By way of example only and not by way of limitation, by having a face of the thread having an angle of between about 10 degrees to about 25 degrees, depending on a given embodiment, the relative number of revolutions on the bone fixture can be higher relative to a bone fixture where the faces on the threads are both 30 degrees.

Figure 3D:
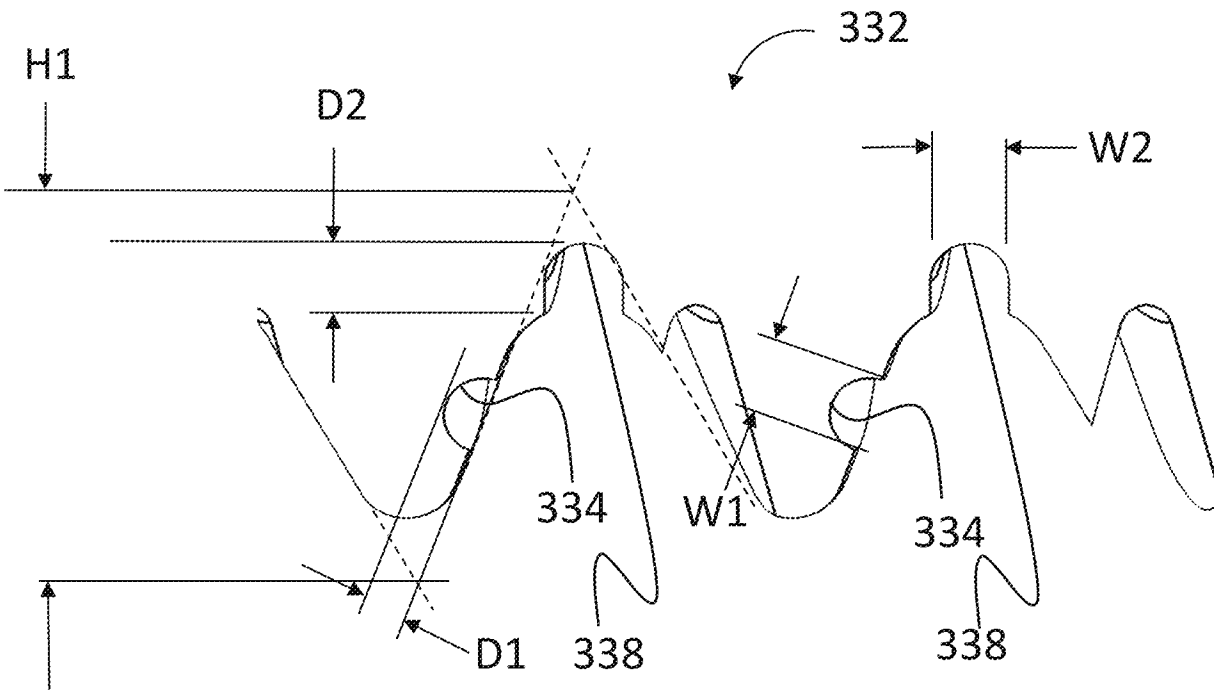
FIG. 3D depicts another portion of the cross-sectional view of FIG. 3A.

As can be seen in FIGS. 3A and 3B, the thread sections have grooves on the flanks thereof. More particularly, FIG. 3A depicts a portion 332 of the bone fixture 310 encompassing two sections of thread. The cross-sectional view of the portion 332 is depicted in FIG. 3D. As can be seen, the proximally facing flanks of the thread (i.e., the flanks of the thread that face the flange 316, or more particularly, face the bottom surface 350 of the flange 316 of the bone fixture 310, and thus face towards the proximal end of the bone fixture) have grooves 334 therein. It is noted that in alternative embodiment, the distally facing flanks of the threads (i.e., the flanks of the thread that face the end of the bone fixture 310/face away from the end that has the flange 316) have grooves therein. It is noted that in yet another alternative embodiment, both the proximally facing flanks and the distally facing flanks of the threads have grooves, where the grooves can be the same as each other and/or different from each other. Still further, while the embodiment of FIG. 3D depicts only one groove located in the proximally facing flank of the thread, in an alternate embodiment two or more grooves can be located in a given flank. This is also the case with respect to the distally facing flank.

In an exemplary embodiment, the depth D1 of the grooves 334 is in the range of about 50 to about 200 μm, and the width W1 of the grooves 334 is in a range of about 70 to about 250 μm.

It is noted that in an exemplary embodiment, the depth D1 of the groove is between about one-fourth and one-seventh the non-truncated height H1 of the thread (distance from an extrapolated root to the extrapolated tip (i.e., the locations where the faces would converge if not for the rounding on the crest and the "sharp corner" relief at the root/base)).

Figure 3E:
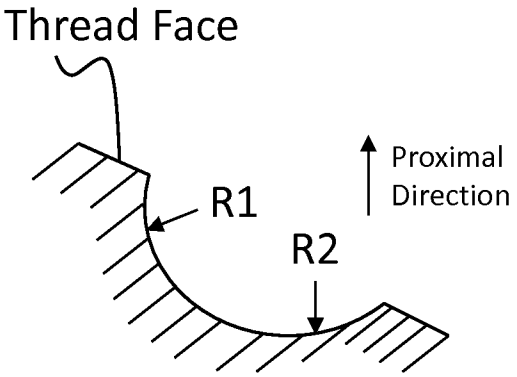
FIG. 3E depicts a schematic representation of a groove that can be utilized in at least some embodiments.
Figure 3F:
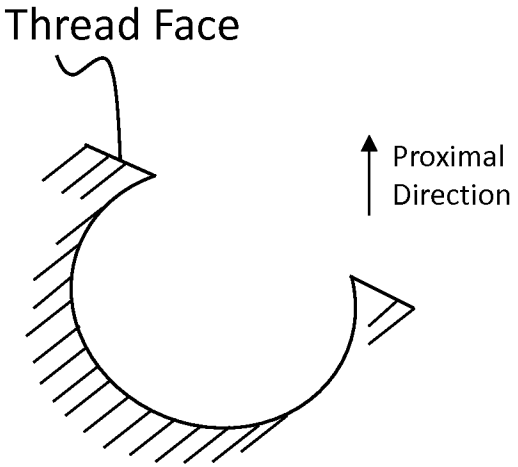
FIG. 3F depicts a schematic representation of another groove that can be utilized in at least some embodiments.
Figure 3G:
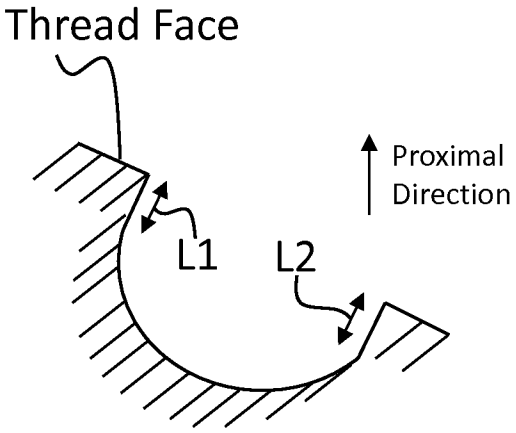
FIG. 3G depicts a schematic representation of another groove that can be utilized in at least some embodiments.

It is noted that the cross-section of the grooves 334 depicted in FIG. 3D are depicted as being substantially hemispherical with the "equator" aligned/flush with the top face of the thread. That said, other configurations can be utilized. By way of example only and not by way of limitation, if a hemispherical cross-section is to be utilized, the depth of the groove can be different from that which would result in the "equator" of the hemisphere being aligned/flush with the top face of the thread. (It is noted that the discussions herein with respect to the "shape" of the grooves 334, the shape corresponds to the cross-section of the grooves as taken on a plane that extends through and is parallel to the longitudinal axis 301 of the bone fixture 310). For example, the hypothetical equator could be proud (above) the face, thus resulting in a groove that is less than a complete hemisphere (the curvature from one face to the other would result in a portion of a circle less than 180 degrees), as is depicted by way of example in FIG. 3E. It is noted that the radius of the curved portion can be constant (i.e., R1=R2). In an alternate embodiment, the curved portion can be a compounded curve (R1 does not equal to R2 and/or there can be other different radii, etc.). In an alternate embodiment, the groove can be semi-spherical in cross-section. In this regard, the "equator" of the sphere can be below the top face (the curvature from one face to the other would result in a portion of a circle greater than 180 degrees), as is depicted by way of example in FIG. 3F (again, where in exemplary embodiments, the curve can be a constant curve or a compound curve vis-à-vis the features of FIG. 3E noted above). Still further, in an exemplary embodiment, the cross-section of the groove(s) can correspond to a "U" shape, with a bottom radius, and straight sides, as depicted by way of example in FIG. 3G. With reference to FIG. 3G, it can be seen that the length of the straight sides can be the same (L1=L2), or the length of the straight sides can be different (L1 does not equal L2). Also, the curved portion can be a constant curve or a compound curve, concomitant with the embodiments noted above. In alternate embodiments, the cross-section can be an elliptical cross section and/or another type of cross-section that follows a mathematically predictable path (as distinguished from a compound curve, having various radaii).

Figure 3H:
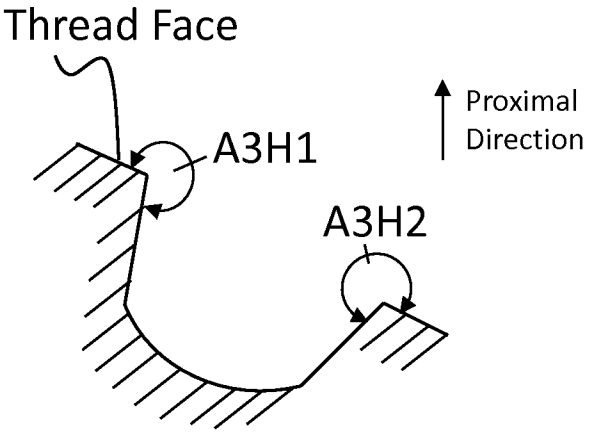
FIG. 3H depicts a schematic representation of another groove that can be utilized in at least some embodiments.
Figure 3I:
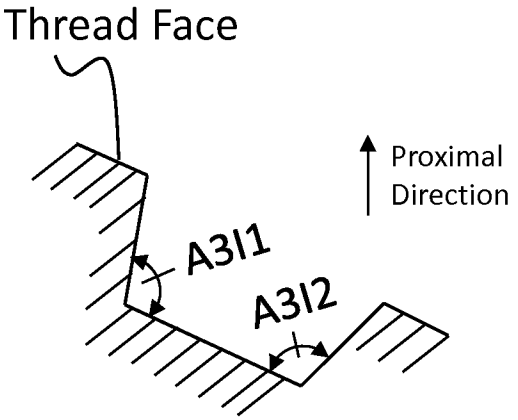
FIG. 3I depicts a schematic representation of another groove that can be utilized in at least some embodiments.
Figure 3J:
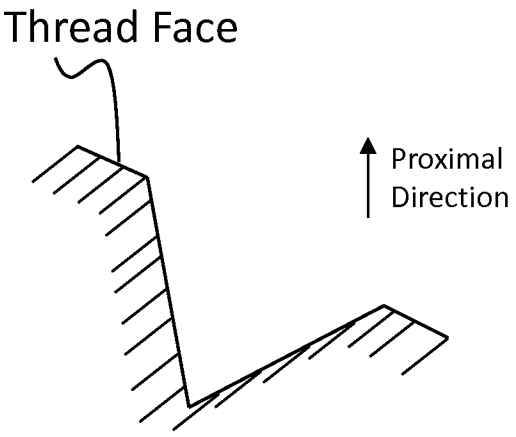
FIG. 3J depicts a schematic representation of another groove that can be utilized in at least some embodiments.

In yet an alternate embodiment, the shape of the groove can be a wedged shape, with or without a bottom radius, as is depicted by way of example in FIGS. 3H and 3I, respectively. With respect to FIG. 3H, it can be seen that angles A3H1 and A3H2 can be equal. In an alternative embodiment, Angles A3H1 and A3*h*2 can be different from each other. Note that this is also the case with the embodiment of FIG. 3I. Also, the curved portion of FIG. 3H can be a constant curve or a compound curve, again concomitant with the embodiments noted above. With respect to FIG. 3I, it is noted that the angles A3I1 and A3I2 can be equal in some embodiments or can be different from each other in some other embodiments. Still further by example, the grooves can be substantially V-shaped, as is depicted by way of example in FIG. 3J. Any shape of a groove that can have utilitarian value or otherwise can enable the teachings detailed herein and/or variations thereof to be practiced can utilize in at least some embodiments.

In at least some embodiments, the grooves are located on substantially all (including all) of the full sections of thread 315 (a "full" thread section is discussed further below). In an exemplary embodiment, the grooves can be located on less than substantially all of the full sections of the thread. In some embodiments, the grooves are located on a minority of the full section of thread (i.e., the total helical length of the groove is less than half that of the total helical length of the full section of thread).

Figure 4A:
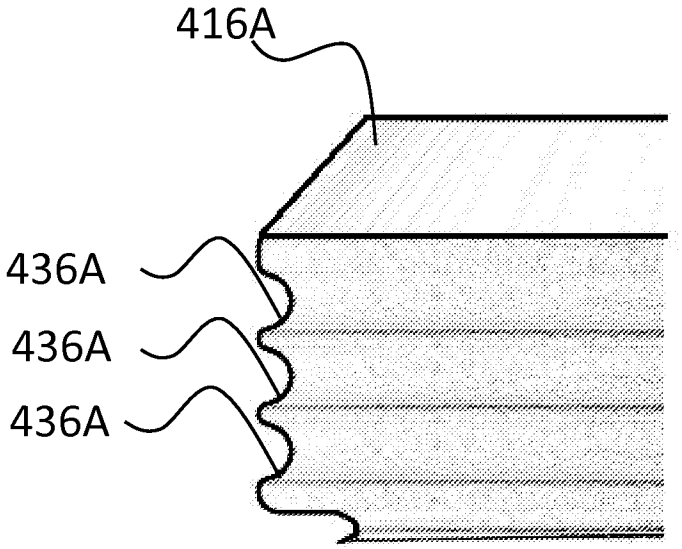
FIG. 4A depicts a side view of a portion of a flange of a bone fixture according to an exemplary embodiment.

It is noted that the shapes of the grooves detailed herein are but examples. In at least some embodiments, grooves of different shapes can be utilized. Any groove shape that can have utilitarian value and/or otherwise can enable the teachings detailed herein or variations thereof to be practiced can be utilized in at least some embodiments Again with reference to FIG. 3A, it is noted that in some embodiments, the flange 316 of the bone fixture 310 includes a groove 336. Referring now to FIG. 4A, an alternate embodiment can include an alternate bone fixture having a flange 416A in which there are two or more grooves 436A. In an exemplary embodiment, the flange 416A includes 1, 2, 3, 4, 5, 6, 7, 8, 9, 10 or more grooves. An exemplary embodiment includes a flange having a number of grooves within any range between 1 and 10 in 1 unit increments (e.g., 1 to 7, 3 to 6, 2 to 9, etc.).

It is noted that in the embodiments where the flange 316/416A includes groove(s), the grooves can correspond to any of the grooves detailed herein and/or variations thereof and/or any other shaped groove that can have utilitarian value and/or otherwise can enable the teachings detailed herein and/or variations thereof to be practiced.

Figure 4B:
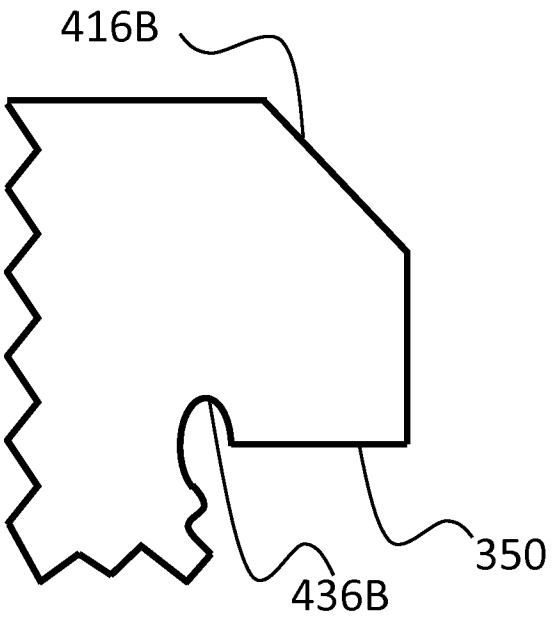
FIG. 4B depicts a side view of another portion of a flange of a bone fixture according to another exemplary embodiment.

Now with reference to FIG. 4B, there is depicted and alternate embodiment of a bone fixture flange 416B (shown in partial cross-sectional view) in which there is a groove 436B located on the bottom surface 350 thereof. In this regard, the groove 436B can span the entire circumference of the threaded portion of the bone fixture. Alternatively, in an alternate embodiment, the groove extends only partially about the threaded portion of the bone fixture. The embodiment of FIG. 4B depicts one groove 436B located on the bottom surface of the flange 416B such that it faces the bone when the bone fixture is implanted into bone. In an alternate embodiment, two or more grooves are located on the bottom portion of the flange. In an exemplary embodiment, the bottom portion of the flange has one, two, three, four, five, six, seven, eight, nine or ten or more grooves, or any range of numbers therebetween in integer increments (e.g., 1 to 5, 3 to 8, etc.), extending partially and/or fully about the threaded portion of the bone fixture. In an exemplary embodiment, one or more or all of the grooves on the bottom of the flange are concentric with the threaded portion of the bone fixture. In some embodiments, some grooves are concentric while others are not. In an exemplary embodiment, the spacing of the grooves is such that they are symmetric/uniform. In an alternate embodiment, the spacing of the grooves is such that they are asymmetric/non-uniform. Any pattern of grooves located on the bottom surface of the flange flange that can have utilitarian value and/or otherwise can enable the teachings detailed herein or variations thereof to be practiced can utilize in at least some embodiments.

The shape of the grooves 436B can correspond to any shape of the grooves 334 and/or the other grooves detailed below as detailed herein. As with the grooves 334, etc., the grooves 436B can have other shapes than those detailed herein. The depths of the grooves and/or the width of the grooves 436B can correspond to those of grooves 334, etc. In this regard, the depth is measured from the extrapolated flat surface of bottom of the flange. The width is measured from the location where the surface of the bone fixture extends below (or more accurately above) the bottom flat portion of the flange.

Again with reference to FIGS. 3A and 3B, and now with reference also to FIG. 3D, some embodiments include grooves 338 at the root (i.e., where the flanks of the thread converge, also referred to as base) of the thread. As can be seen, the root of the thread have a groove 338 therein. In an exemplary embodiment, the depth D2 of the grooves 338 is in the range of about 50 to 200 μm, and the width W2 of the grooves 338 is in a range of about 70 to 250 μm.

It is noted that in the embodiments where the root of the thread includes the groove, the groove can correspond to any of the grooves detailed herein and/or variations thereof and/or any other shaped groove that can have utilitarian value and/or otherwise can enable the teachings detailed herein and/or variations thereof to be practiced.

In at least some embodiments, the groove of the root runs with substantially all (including all) of the full sections of thread (again, a "full" thread section is discussed further below). In an exemplary embodiment, the grooves can run with less than substantially all of the full sections of the thread. In some embodiments, the groove runs a length that corresponds to a minority of the length of the full section of thread (i.e. the total helical length of the groove is less than half that of the total helical length of the full section of thread).

Also, the groove 338 can be present in multiple segments. That is, it can run with a portion of the thread, and then stop, and then begin again, and then stop, etc. It is noted that this is the case for the groove 338 and for any of the other grooves detailed herein (e.g., groove 334, etc.).

Figure 5:
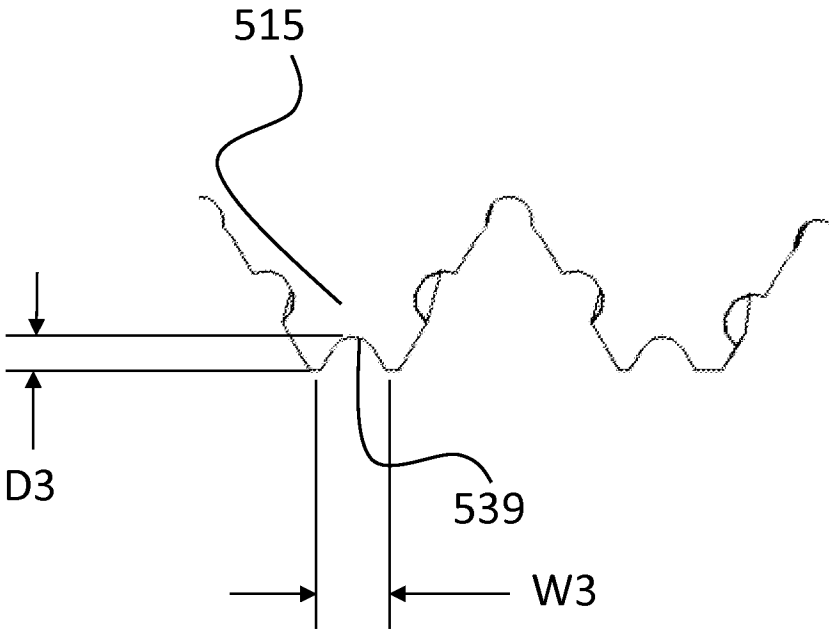
FIG. 5 depicts a portion of a cross-section of a full thread.

In an alternate embodiment of an exemplary bone fixture, a groove is located at the crest of the thread. In this regard, FIG. 5 depicts a portion of a cross-section of a portion of a thread 515, which can correspond to threads 315. As can be seen, the crest of the thread 515 includes a groove 539. In an exemplary embodiment, the depth D3 of the groove 539 is in the range of about 50 to 200 μm, and the width W3 of the groove 539 is in a range of 70 to 250 μm.

It is noted that in the embodiments where the crest of the thread includes the groove, the groove can correspond to any of the grooves detailed herein and/or variations thereof and/or any other shaped groove that can have utilitarian value and/or otherwise can enable the teachings detailed herein and/or variations thereof to be practiced.

In at least some embodiments, the groove 539 of the crest is located on substantially all (including all) of the full sections of thread. In an exemplary embodiment, the crest groove can be located on less than substantially all of the full sections of the thread. In some embodiments, the crest groove is located on a minority of the full section of thread (i.e. the helical length of the groove is less than half that of the helical length of the full section of thread).

Figure 6B:
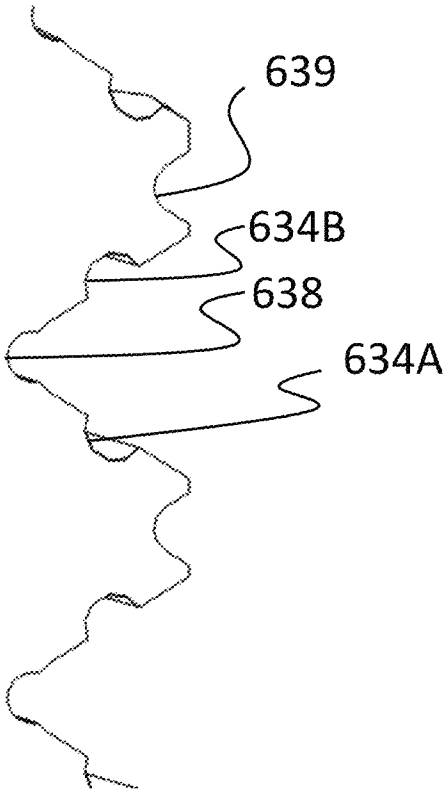
FIGS. 6A and 6B depict a portion of a full thread and a cross-section thereof, respectively.
Figure 6A:
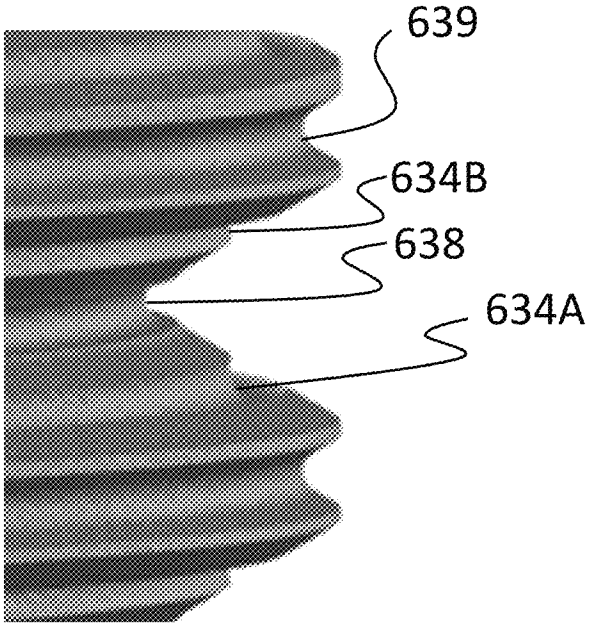

It is noted that in an alternative embodiment, the bone fixture can include the combination of two or more of the groove placements detailed herein and/or variations thereof. That is, the embodiments of FIGS. 3C and 3D (flank groove and/or root groove) can be combined with the embodiment of FIG. 5 (crest groove) and/or the embodiment of FIG. 4A (flange groove). FIGS. 6A and 6B, which respectively depict an isometric view and a cross-section of the threaded portion of an exemplary bone fixture, depicts such an exemplary embodiment. As can be seen, the embodiments of FIGS. 6A and 6B have flank grooves 634A and 634B (facing the proximal end and the distal end, respectively, of the bone fixture), a root grove 638 and a crest groove 639.

In a similar vein, it is noted that in at least some embodiments, there is a bone fixture that includes any one or more features detailed herein combined with any one or more other features detailed herein.

As can be seen in the figures, the groove(s) run parallel to the thread direction. As will be discussed below, in some other embodiments, grooves can run in a different direction.

Any type of groove that can enable the teachings detailed herein and/or variations thereof to be practiced can be utilized in at least some embodiments.

As noted above, the exemplary embodiments of the bone fixture 310 of FIGS. 3A and 3B includes a flat section 302. In an exemplary embodiment, the flat section 302 is a cutting pocket extending across two or more thread crests relative to the longitudinal axis 301 of the bone fixture 310 (the embodiment depicted in FIGS. 3A and 3B has a cutting pocket extending across three thread crests). In some embodiments, there are one or more such cutting pockets. In an exemplary embodiment, there is a bone fixture that has three such cutting pockets arrayed symmetrically (which includes symmetrically) about the longitudinal axis 301 (i.e., at about 120 degree increments). In an exemplary embodiment, there is a bone fixture having one, two, three, four, five, six, seven, eight or more cutting pockets or any value or range of values therebetween in integer increments. In some embodiments, these are arrayed symmetrically about the longitudinal axis 301. That said, in an alternate embodiment, the cutting pockets are not arrayed symmetrically/they are arrayed asymmetrically about the longitudinal axis 301. Further, while the embodiment of the pocket 302 depicted in FIG. 3A extends across three thread crests, in alternate embodiments, cutting pockets can extend across one, two, three, four, five, six or more thread crests or any value or range of values therebetween in integer increments. It is noted that in embodiments that utilize more cutting pockets than that of other embodiments, the cutting pockets of the former can have dimensions that are smaller relative to those of the latter, so as to, for example, provide sufficient space for the pockets. For example, the former can have cutting pockets that are shallower than the latter. By way of example only and not by way of limitation, such can have utility in embodiments where the cutting pockets are formed by flats; the shallower the cutting pockets, the less circumferential area that the cutting pockets take up relative to rotation about the longitudinal axis 301, Thus providing more room for additional pockets relative to that which would be the case in the absence of the shallower cutting pockets.

Note further, that in some embodiments, the cutting pockets are not uniform. That is, in some embodiments, the bone fixture has two or more cutting pockets, where one or more cutting pockets is different from one or more other cutting pockets.

In an exemplary embodiment, the cutting pockets 302 provide for respective cutting edge lines 303, where the edge lines 303 is defined by the edges of the thread. In an exemplary embodiment, the cutting pockets 302 in general, and the edge lines 303 particular, provide a self-tapping functionality of the bone fixture 310.

With reference to FIG. 3A, the cutting pocket 302, or more particularly, the cutting edge 303 of the cutting pocket 302, is a spiral cutting pocket. That is, instead of the cutting edge 303 extending in the longitudinal direction in a manner that is substantially parallel to the longitudinal axis 301, the cutting edge 303 spiral about the longitudinal axis 301. In the embodiment depicted in FIG. 3A, the cutting edge 303 spirals in a direction counter to the direction of the thread 315. That said, in an alternate embodiment, the cutting edge 303 can spiral in a direction consistent with the direction of the thread 315.

With respect to the embodiment of FIG. 3A, the pitch of the threads 315 are right-handed, while the pitch of the spiral cutting edge 303 is left-handed. In the embodiment of FIG. 3A, the relative pitch of the threads 315 is smaller than that of the cutting edge 303. Continuing in terms of pitch, the cutting edges 303 can be considered as a thread about the longitudinal axis 301, where embodiments of the bone fixture that have two or three or four, etc., pockets 302 correspond to, respectively a bone fixture having a double, triple, or quintuple, etc., threaded body vis-à-vis the cutting edge.

Further, the pitch of the spiral cutting-edge 303 can be uniform relative to location along the longitudinal axis 301, or can vary relative to the location along the longitudinal axis 301. Further, in an exemplary embodiment, one or more portions of the cutting edge 303 can be spiral, and one or more portions of the cutting-edge can extend parallel to the direction of the longitudinal axis 301. In an exemplary embodiment of the aforementioned exemplary embodiment, one or more portions of the cutting edge 303 that spiral can spiral in one direction (e.g., counter to the direction of the threads 315), and one or more portions of the cutting edge 303 that spiral can spiral in counter direction (e.g., consistent with the direction of the threads 315). Note further, in an exemplary embodiment of this exemplary embodiment, there may not be any portions of the cutting edge 303 that extend parallel to the direction the longitudinal axis 301. That is, in an exemplary embodiment, the cutting edge 303 spirals in one direction, and then spirals in a counter direction without extending in a direction parallel to the longitudinal axis 301. Note further that an exemplary embodiment includes any of the aforementioned embodiments, where the pitch of the spiral cutting edge 303 varies with position along the longitudinal axis 301 as detailed above.

Continuing with reference to FIG. 3A, it is noted that in some embodiments, the cutting pocket 302 includes at least one structural surface feature configured to promote growth of the recipient's skull bone. In this regard, as can be seen, pocket 302 includes grooves 342. The embodiment depicted in FIG. 3A, there are four grooves 342 that at least generally follow the direction of the edge 303. That is, in the exemplary embodiment depicted in FIG. 3A, the pitch of the grooves 342 corresponds to that of the cutting edge 303. In an alternative embodiment, the pitch of the grooves 342 can have a different pitch than that of the cutting-edge 303. Still further, in some embodiments, the pitch of the respective grooves 342 can be different from one another.

It is noted that while the embodiment of FIG. 3A depicts four grooves 342, alternate embodiments can include fewer grooves or more grooves, in an exemplary embodiment, the pockets 302 can have one, two, three, four, five, six, seven, eight, nine, ten or more grooves 342 or can be any number or range of grooves anywhere therebetween in integer increments (e.g., 2 to 8 grooves, 3 to 5 grooves, 1 to 10 grooves, etc.). It is further noted that the grooves of one pocket/the groove system (i.e. the collective grooves of one pocket) of one pocket can be different from those of another pocket. This can be the case irrespective of whether the respective pockets are different from one another or the same.

The shape of the grooves 342 can correspond to any shape of the grooves 334, 336, 338 and/or 539 as detailed herein. As with the grooves 334, 336, 338 and 539, the grooves 342 can have other shapes than those detailed herein. The depths of the grooves and/or the width of the grooves 342 can correspond to those of grooves 334, 336, 338 and 539.

In an exemplary embodiment, the grooves (342, 334, 336, 338, 539) are configured to promote growth of the recipient's skull bone after implantation of the bone fixture into the skull. In this regard, the grooves constitute at least one structural surface feature configured to promote the growth of bone. With respect to the grooves on the side of the flange (e.g., the embodiment of FIG. 4A), over time, bone will grow along the longitudinal direction of the bone fixture, and thus envelop a portion of the flange, and thereby interact with the grooves 336/436A.

In a similar vein, some exemplary embodiments of some exemplary bone fixtures include a porous-solid scaffold that is configured to promote growth of the recipient's skull bone. More particularly, in an exemplary embodiment, the screw thread of the bone fixture (e.g., thread 315) includes a portion that includes such a porous-solid scaffold.

Figure 7:
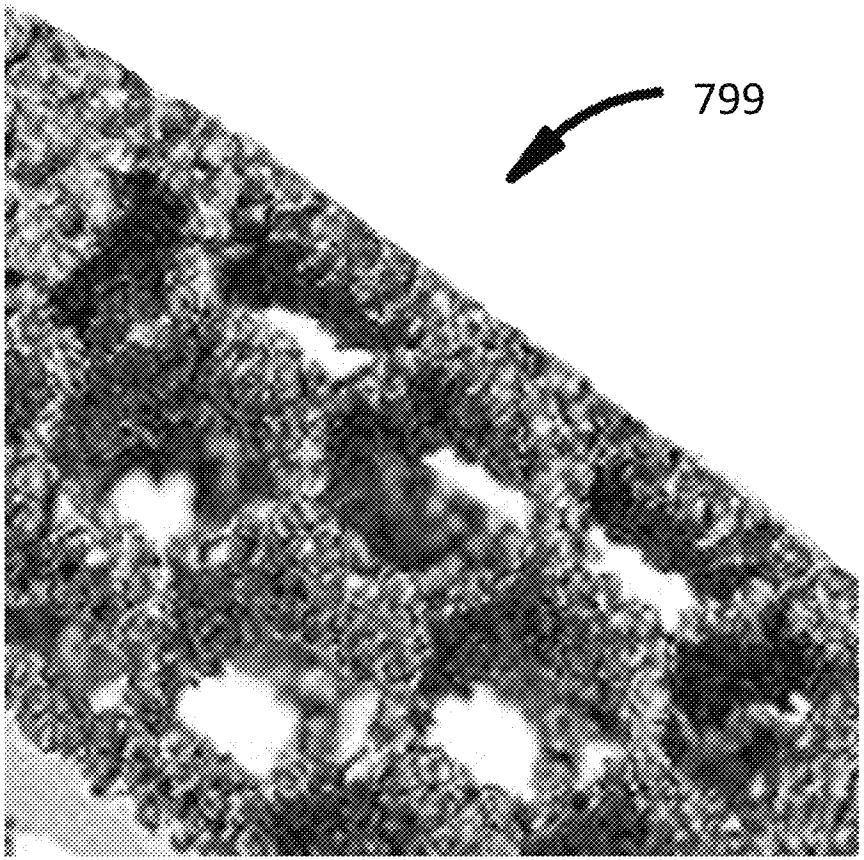
FIG. 7 depicts an exemplary embodiment of a structure of a portion of the exemplary bone fixture.

FIG. 7 illustrates an exemplary structure usable in at least some embodiments of some exemplary bone fixtures. Specifically, FIG. 7 depicts an implantable component has a trabecular (bone-like) structure/a 3 dimensional structure. More specifically, FIG. 7 illustrates an enlarged view of a portion 799 of a body of an implantable component configured to be implanted adjacent to a recipient's bone and is configured to promote bone ingrowth and/or ongrowth to interlock the implantable component with the recipient's bone. In the embodiments of FIG. 7, the portion 825, as well as the remainder of the osteoconductive implantable component, is a porous-solid scaffold that comprises an irregular three-dimensional array of struts. In an exemplary embodiment, the irregular scaffold of FIG. 7 allows for vascular and cellular migration, attachment, and distribution through the exterior pores into the scaffold. The porous solid scaffold FIG. 7 may be formed, for example, from a solid titanium structure by chemical etching, photochemical blanking, electroforming, stamping, plasma etching, ultrasonic machining, water jet cutting, electrical discharge machining, electron beam machining, or similar process.

Embodiments utilizing the structure of FIG. 7 provide an osteoconductive implantable component that has a porous structure to facilitate bone ingrowth and/or ongrowth so as to interlock the implantable component with the recipient's skull bone. In the above embodiments, the bottom (i.e., bone-facing) surface has the same structure as the rest of the implantable component (i.e., generally porous).

Hereinafter, such structures are referred to as a porous-solid scaffold. Some exemplary embodiments of a porous-solid scaffold that can be utilized with embodiments detailed herein and/or variations thereof are disclosed in U.S. patent application Ser. No. 14/032,247, filed on Sep. 20, 2013, naming Goran Bjorn and Jerry Frimanson as inventors.

In an exemplary embodiment, porous-solid scaffold forms at least a portion of the surface of the bone fixture. In an exemplary embodiment, the porous-solid scaffold extends a certain depth below the surface of the bone fixture. That is, in an exemplary embodiment, the entire bone fixture is not a porous-solid scaffold.

Figure 8:
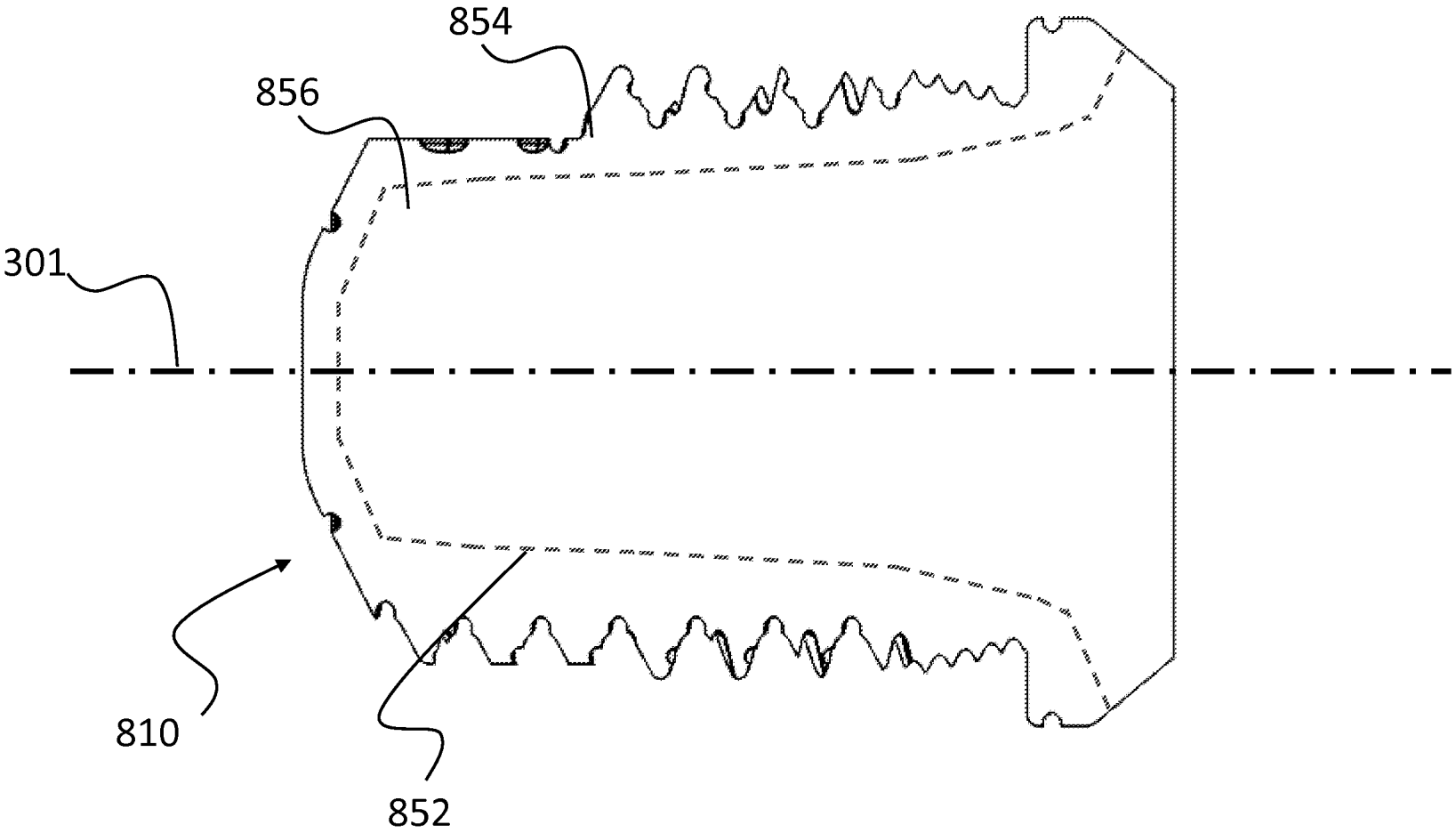
FIGS. 8, 9, 10, 11 and 12 depict alternate boundaries of the exemplary structure of FIG. 7 as applied to an exemplary bone fixture.

More particularly, referring to FIG. 8, there is an illustrative diagram of a cross-section of a bone conduction device depicting an exemplary depth of the porous-solid scaffold. FIG. 8 depicts a bone fixture 810 that can correspond to any of the bone fixture detailed herein and/or variations thereof. Superimposed onto the view of FIG. 8, there is a boundary 852 that represents the boundary between the porous-solid scaffold structure of the bone fixture 810 (the area represented by numeral 854) and the rest of the structure of the bone fixture 810 (the area represented by numeral 856. The boundary 852 is representative and presented to illustrate the concept that the bone fixture 810 can be a monolithic bone fixture that has two different structures (the porous-solid scaffold structure of 854 and the non-porous structure represented by numeral 856). Accordingly, in at least some embodiments, the boundary 852 will be different from that depicted. Indeed, while the boundaries depicted as a relatively orderly and smooth boundary, in practice, the boundary may be more jagged and/or may follow a more meandering path. Indeed, in some configurations, precise and/or orderly boundaries are not present, because, in some applications, loose and meandering boundaries can provide sufficient utilitarian value in some applications.

Still, in at least some embodiments, the depth of the porous-solid scaffold extends only a fraction of the way into the bone fixture as can be seen in FIG. 8. In an exemplary embodiment, the depth of the porous-solid scaffold extends from about 0.1 mm to about 1 mm beneath the surface of the bone fixture, or any value or range of values therebetween in about 0.01 mm increments (e.g., about 0.14 mm to about 0.66 mm, 0.33 mm, 0.28 mm, etc.). That said, in some embodiments, the depth can be greater than about 1 mm.

Figure 9:
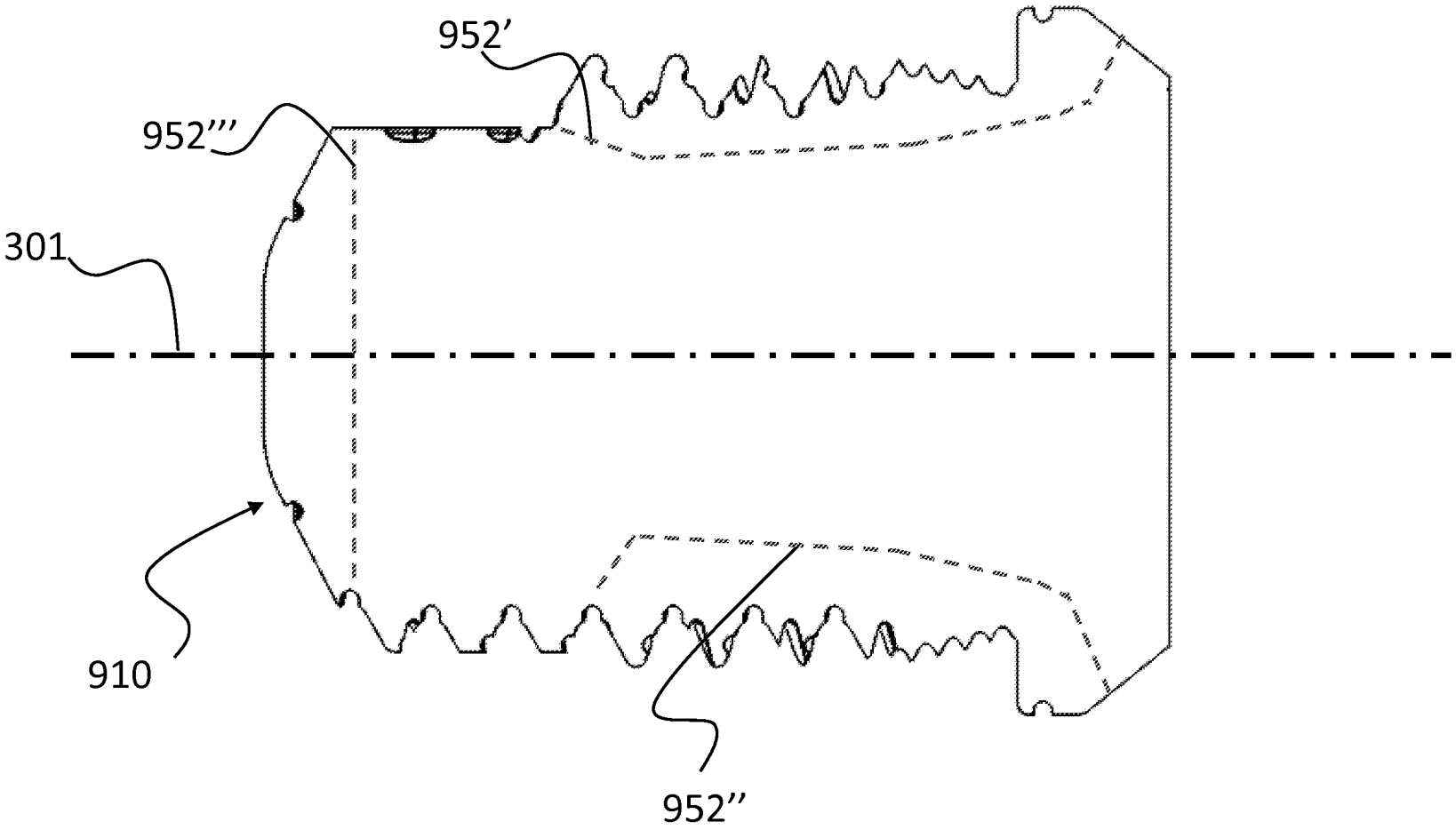

Further, while the embodiment of FIG. 8 is depicted as having a generally contiguous boundary from one side of the bone fixture to the other (relative to the longitudinal axis 301 in the plane of the drawling) in other embodiments, the porous-solid scaffold structure forms pockets relative to one another, as is depicted by way of example only and not by way of limitation in FIG. 9 vis-à-vis boundaries 952'/952" and 952'. Note further that FIG. 9 depicts a configuration where the pockets of the porous-solid scaffold structure are not symmetric relative to the axis 301. In a similar vein, the porous-solid scaffold structure does not extend completely about the longitudinal axis 301 that is, in an exemplary embodiment, pockets about the longitudinal axis 301 may be present. By way of example only and not by limitation, the pockets might be symmetrically and/or asymmetrically arrayed about the longitudinal axis 301. In an exemplary embodiment, there can be 2, 3, 4, 5, 6, 7, 8, 9, 10 or more pockets arrayed about axis 301. Moreover, there can be various pockets arrayed about the bone fixture in a camouflage or random manner. Any disbursement of the scaffold structure that can enable the teachings detailed herein and/or variations thereof to be practiced can be utilized in at least some embodiments.

In view of FIGS. 8 and 9, an exemplary embodiment includes a bone fixture that includes a solid inner core section and an outer section that includes the porous-solid scaffold.

Any arrangement of the porous-solid scaffold structure that can provide utilitarian value and/or otherwise enable the teachings detailed herein can be utilized in at least some embodiments.

Also, in an exemplary embodiment, the porous-solid scaffold structure is present in a localized/targeted manner as opposed to the global/quasi-global arrangement of FIGS. 8 and 9 (the embodiments of FIGS. 8 and 9 are analogous to continents, whereas the following is analogous to islands). In this regard, FIG. 10 depicts a cross-section of an exemplary bone fixture 1010 having such localized structures.

More specifically, as can be seen, the boundaries 1052 of the porous-solid structure are localized at the root of the thread, where the boundaries 1052 are only depicted on one side of the bone fixture 1010 for clarity. As with the boundaries of FIGS. 8 and 9, the boundaries depicted in FIG. 10 are conceptual. In implementation, the boundaries might be less uniform and/or the boundaries might merge together.

Figure 10:
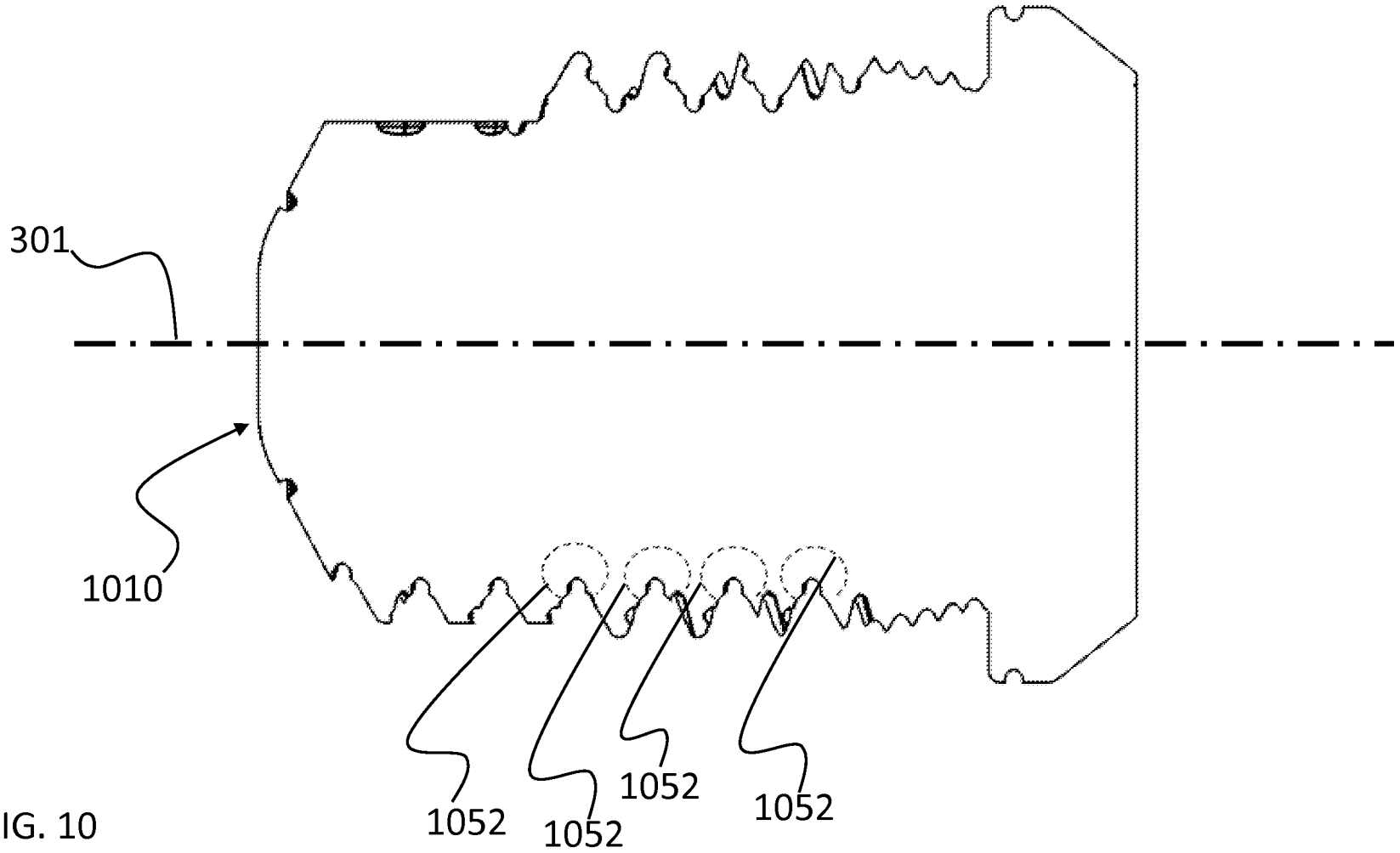

In view of the above, according to an exemplary embodiment, the porous-solid scaffold is located at least at the root of the thread (e.g., the embodiment of FIGS. 8 and 10).

Figure 11:
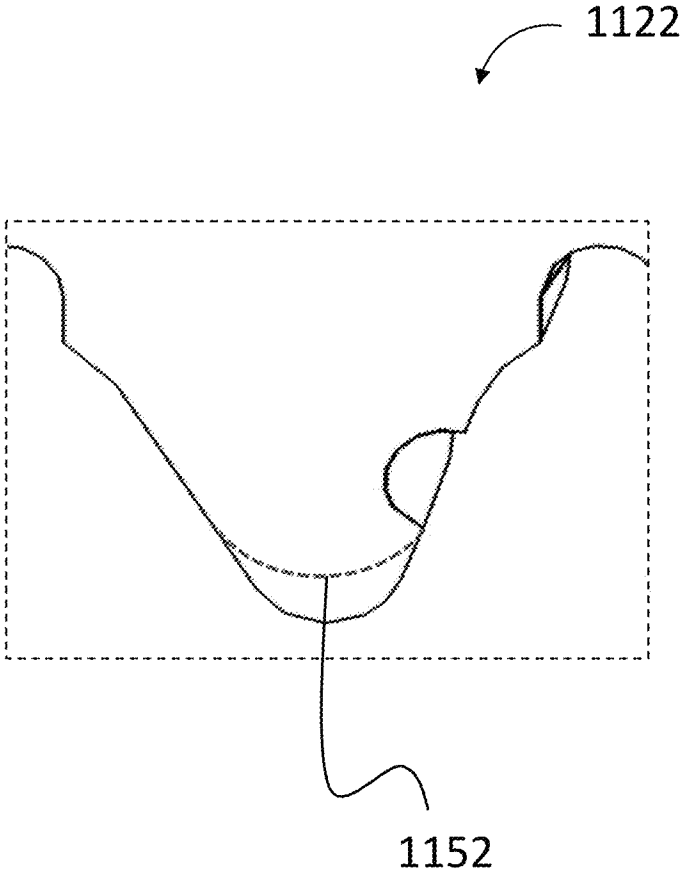

FIG. 11 depicts a section 1122 corresponding to section 322 of the thread 315 of bone fixture 310, except that section 1122 includes a portion that includes the porous-solid scaffold. More particularly, FIG. 11 depicts the conceptual boundary 1152 between the porous-solid scaffold located at the crest of the thread. As depicted, the boundary is parabolic. In an alternative embodiment, the boundary can be of another shape (e.g. straight). Further, while the embodiment of FIG. 11 depicts a boundary relatively close to the crest of the thread, an alternate embodiment, the boundary can be located further away from the thread. Alternatively, it can be located closer to the surface of the crest.

In view of the above, according to an exemplary embodiment, the porous-solid scaffold is located at least at the crest of the thread (e.g., the embodiment of FIGS. 8 and 11).

Figure 12:
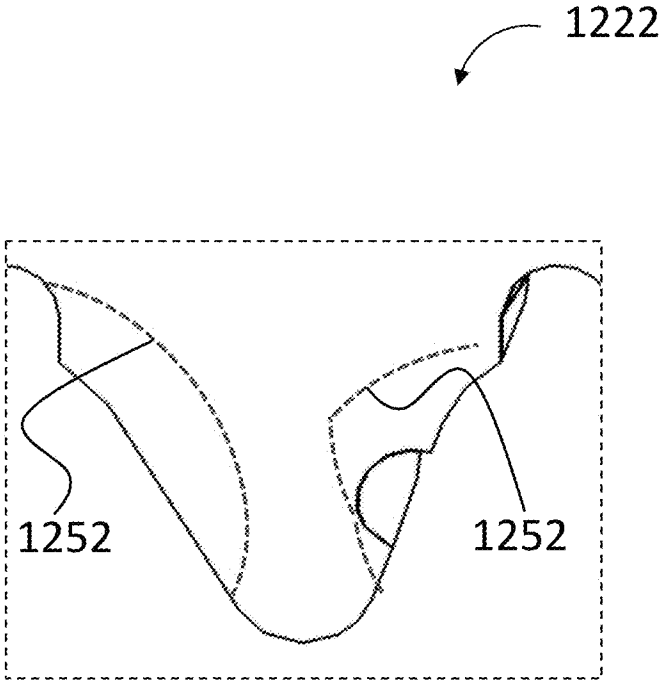

FIG. 12 depicts a section 1222 corresponding to section 322 of the thread 315 of bone fixture 310, except that section 1122 includes a portion that includes the porous-solid scaffold. More particularly, FIG. 12 depicts the conceptual boundaries 1252 between the porous-solid scaffold located at the flanks of the thread. As depicted, one of the boundaries is parabolic, and the other boundary is jagged, owing to the presence of the respective groove. In an alternative embodiment, the boundary can be of another shape (e.g. straight). Further, while the embodiment of FIG. 12 depicts a boundary relatively close to the face of the flank of the thread, an alternate embodiment, the boundary can be located further away from the thread. Alternatively, it can be located closer to the face. It is further noted that while the embodiment of FIG. 12 depicts the porous-solid scaffold on both flanks, in an alternate embodiment, the porous-solid scaffold is located at one side of the flank.

In view of the above, according to an exemplary embodiment, the porous-solid scaffold is located at least at the flank of the thread (e.g., the embodiment of FIGS. 8 and 12)

In some embodiments, some of the bottom surface 350 (including all of the bottom surface) of the flange 316 is formed by the aforementioned porous-solid scaffold noted above (other areas of the flange 316 and/or other areas of the bone fixture can also have the porous-solid scaffold). Thus according to an exemplary embodiment, the porous-solid scaffold is located at least at the bottom surface of the flange 316.

Some additional surface features that promote osseointegration of an implantable component with a recipient's skull bone utilized in some exemplary embodiments of a bone fixture will now be described.

Figure 13A:
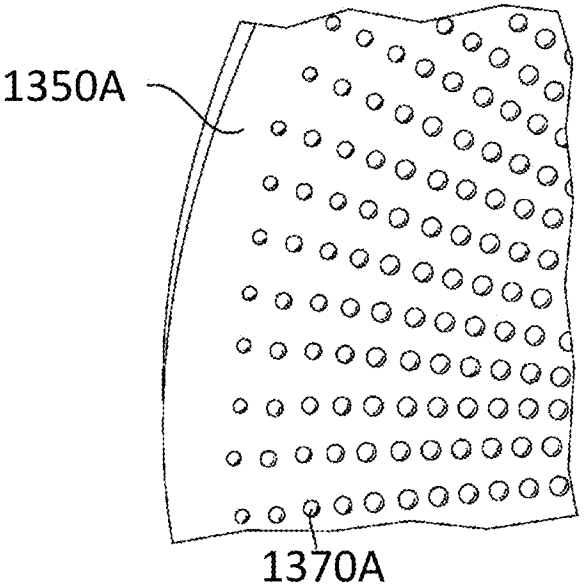
FIGS. 13A-13K depict exemplary surface discontinuities according to an exemplary embodiment.
Figure 13B:
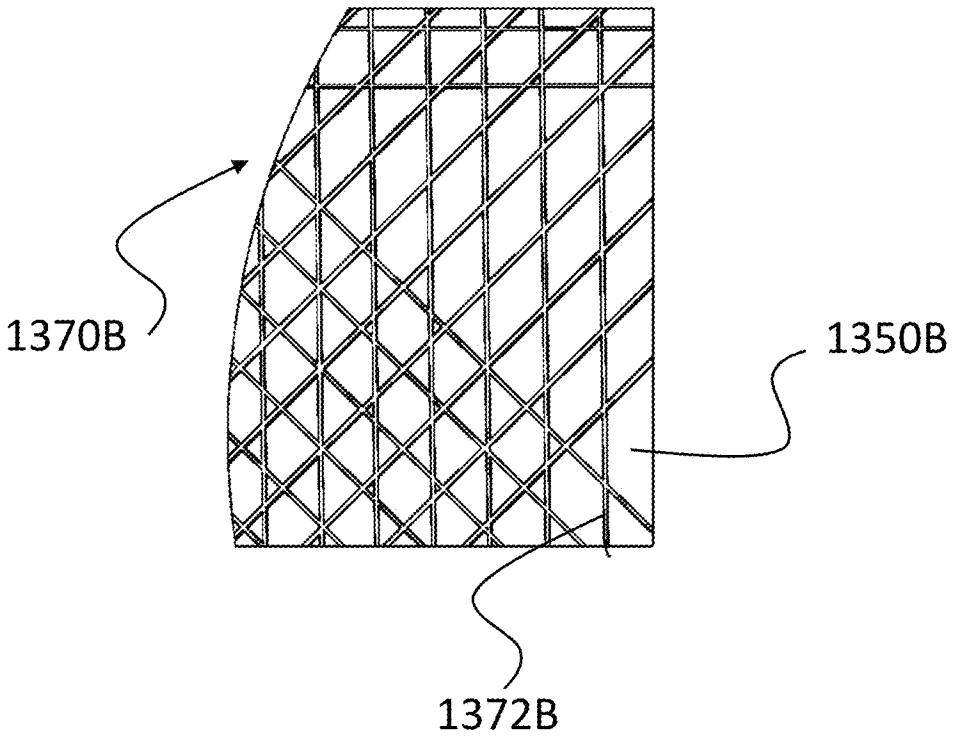
Figure 13C:
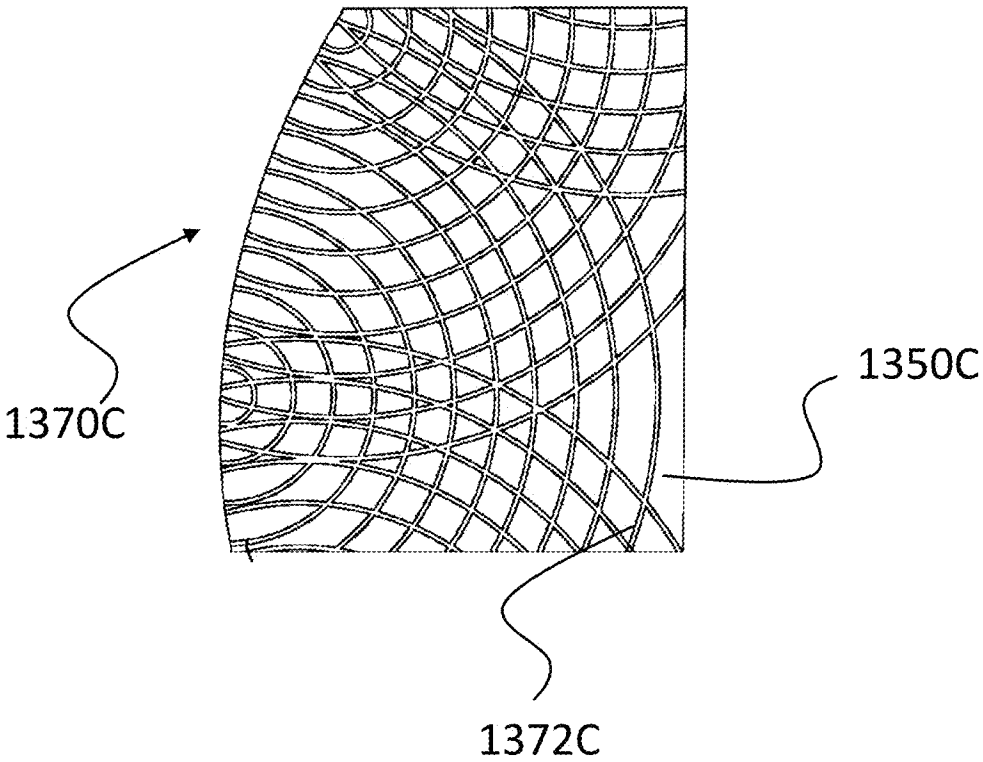

FIGS. 13A, 13B and 13C illustrate further surface features that may be formed at locations on some exemplary bone fixtures, such as the bottom surface 350. In this regard, in an exemplary embodiment, the flange section 316 of the bone fixture 350 can have a surface discontinuity. For example, instead of and/or in addition to surface discontinuities achieved via the grooves detailed above with respect to FIG. 4A or 4B, or the porous porous-solid scaffold of FIG. 7, the flange section 316 can include one or more of the surface features shown in FIGS. 13A-13C, which, in some embodiments, are patterned microstructures that are configured to promote osseointegration of an implantable component with a recipient's skull bone. (Note that as with the grooves of FIGS. 4A and 4B, etc., other portions of the bone fixture 310 can include these surface features.)

FIG. 13A illustrates an arrangement in which a plurality of rounded or dome-shaped protrusions 1370A extend from a bottom surface 1350A (corresponding to bottom surface 350) of a bone fixture. It is noted that in some embodiments, the protrusions shown in FIG. 13A can be used in combination with a porous scaffold as described above. In certain such embodiments, a bottom surface may include both osteoconductive pores and protrusions as describe above with reference to FIG. 13A.

FIGS. 13B and 13C illustrate further embodiments in which the surface features comprise a pattern of grooves disposed in a bottom surface 350 of a bone fixture. More specifically, FIG. 13B illustrates a pattern 1370B of intersecting linear grooves 1372B (i.e., grooves formed as straight lines) in surface 1350B, which corresponds to bottom surface 350. FIG. 13C illustrates a pattern 1170C of intersection curved grooves 1372C (i.e., grooves formed as curved lines) in surface 1350C, which corresponds to bottom surface 350. The grooves 1372B and/or 1372C may have a depth in the range of approximately 50 micrometers to approximately 200 micrometers and a width in the range of approximately 70 micrometers to approximately 350 micrometers.

The shape of the grooves in the embodiments of FIGS. 13B and 13C the grooves are configured to promote bone growth in a direction that is substantially perpendicular to a surface of the recipient's skull.

In certain embodiments of FIGS. 13B and 13C, one or more of the grooves include portions that, when the bone fixture is implanted, are substantially parallel to a surface of the recipient's skull to promote bone growth in a direction that is substantially parallel to the surface of the recipient's skull. In other embodiments, or more of the grooves include portions that, when the implantable component is implanted, are positioned at an angle relative to a surface of the recipient's skull to promote bone growth at an angle relative to the surface of the recipient's skull.

As with the embodiment of FIG. 13A, the embodiments of FIGS. 13B and 13C can be in combination with a porous scaffold as described above. In certain such embodiments, the bottom surfaces 1350B and 1350C may include both osteoconductive pores (as described above) and grooves as describe above. Again, in at least some embodiments, any one or more of the teachings detailed herein can be combined with any one or more other teachings detailed herein.

It is noted that the shapes of the grooves of FIGS. 13B and 13C can correspond to that of the grooves detailed above and/or variations thereof.

Figure 13D:
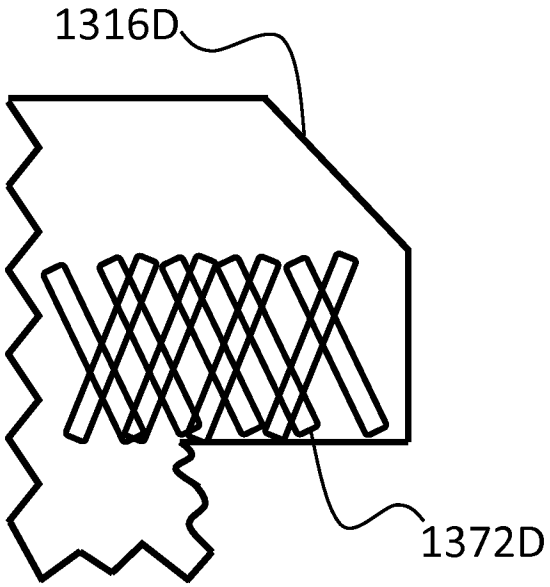

FIG. 13D depicts an alternate embodiment utilizing the exemplary grooves and/or microstructures detailed herein. More specifically, FIG. 13D depicts a side view of an alternate embodiment of a portion of a bone fixture flange 1316D in which there is are a plurality of elements 1372D in a crisscross pattern, overlapping one another (although in other embodiments, the elements do not overlap each other, or at least some of the elements do not overlap some of the other elements), where the elements are located on the outer circumference of the flange of the bone fixture. In an exemplary embodiment, the elements 1372D correspond to grooves and/or the microstructures detailed herein and/or variations thereof. It is noted that the elements 1372D can be located at other locations on the bone fixture flange 1316D. As can be seen, the elements 1372D have a longitudinal axis that is offset from the longitudinal axis of the bone fixture.

Figure 13E:
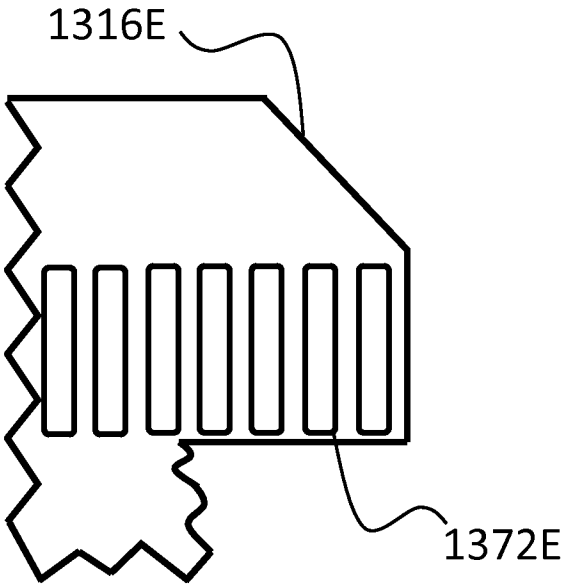

FIG. 13E depicts yet another alternate embodiment utilizing the exemplary grooves and/or microstructures detailed herein. More specifically, FIG. 13E depicts a side view of an alternate embodiment of a portion of a bone fixture flange 1316E in which there is are a plurality of elements 1372E spaced apart from one another, where the elements are located on the outer circumference of the flange of the bone fixture. In an exemplary embodiment, the elements 1372E correspond to grooves and/or the microstructures detailed herein and/or variations thereof. It is noted that the elements 1372E can be located at other locations on the bone fixture flange 1316E. As can be seen, the elements 1372E have a longitudinal axis that is parallel to the longitudinal axis of the bone fixture. In this exemplary embodiment, the elements 1372F are in the form of splines.

Figure 13F:
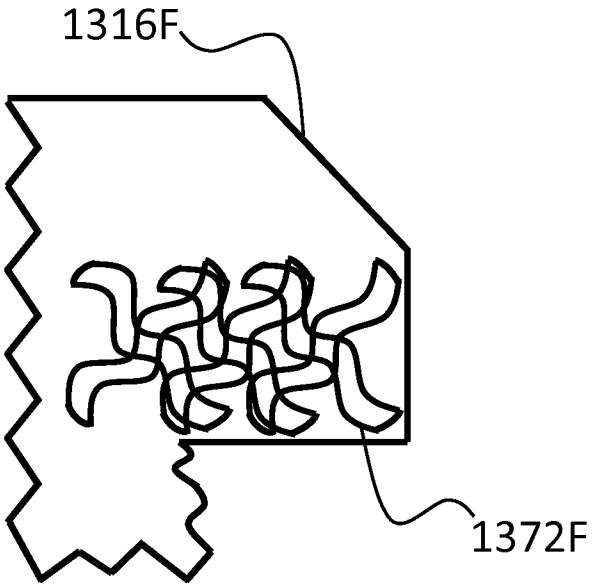

FIG. 13F depicts yet another alternate embodiment utilizing the exemplary grooves and/or microstructures detailed herein. More specifically, FIG. 13F depicts a side view of an alternate embodiment of a portion of a bone fixture flange 1316F in which there is are a plurality of elements 1372F overlapping each other (although in other embodiments, the elements do not overlap each other, or at least some of the elements do not overlap some of the other elements), where the elements are located on the outer circumference of the flange of the bone fixture. In an exemplary embodiment, the elements 1372F correspond to grooves and/or the microstructures detailed herein and/or variations thereof. It is noted that the elements 1372F can be located at other locations on the bone fixture flange 1316F. In the exemplary embodiment, the elements 1372F are in a wave form. In an exemplary embodiment, the wave form can be a predictable wave form (e.g., a sine wave) and/or can be in a chaotic wave form.

Thus, in an exemplary embodiment, the element(s) (groove or microstructure) can have a varying distance from the crest and the troth of the tread. For example, the groove can extend in a waveform manner with location along the longitudinal direction of the thread. That is, the groove can be such that the center of the groove "moves" toward the crest, and then "moves" away from the crest and towards the trough, and then back towards the crest, and so on, with location of the groove in the longitudinal direction.

It is also noted that in some embodiments, the groove can have a constant distance (relative to the center of the groove, for example) from the crest and/or trough, at some sections, and at other sections, can have a varying distance. Also, the sections having varying distances can have different types of varying distances.

The elements 1372D, 1372E and 1372F are configured to promote bone growth in a direction that is substantially perpendicular to a surface of the recipient's skull.

It is noted that alternate embodiments can have different geometries than those detailed in FIGS. 13D-13F. Also, embodiments of these FIGS. can be combined in some embodiments. As with all of the embodiments herein (unless stated otherwise), the elements of FIGS. 13D, 13E and/or 13F and the variations thereof can be applied in other locations. For example, the wave pattern can be located on the faces of the threads (as noted above)—e.g., groove 634A of FIG. 6A can be replaced with any of the elements of FIGS. 13D-13F or variations thereof.

Figure 13G:
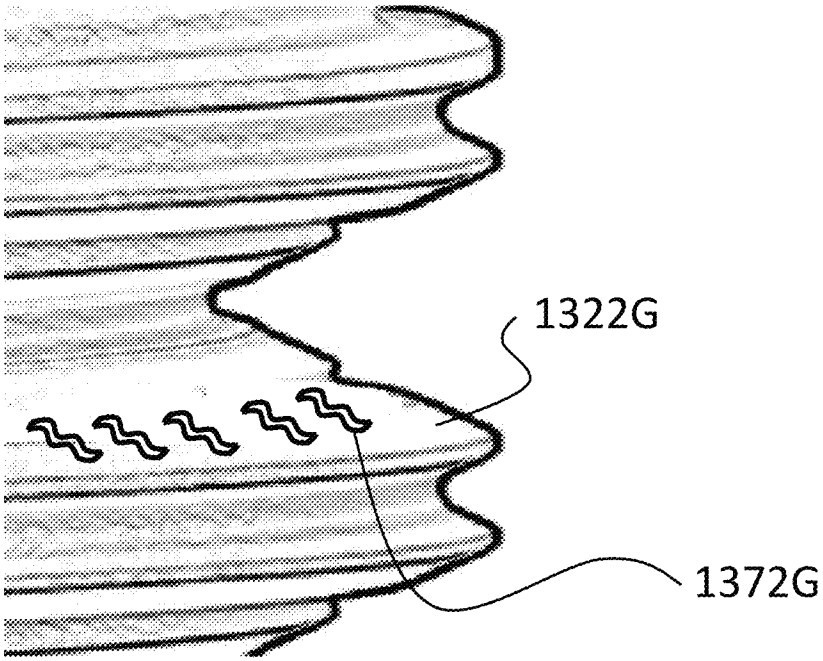
Figure 13H:
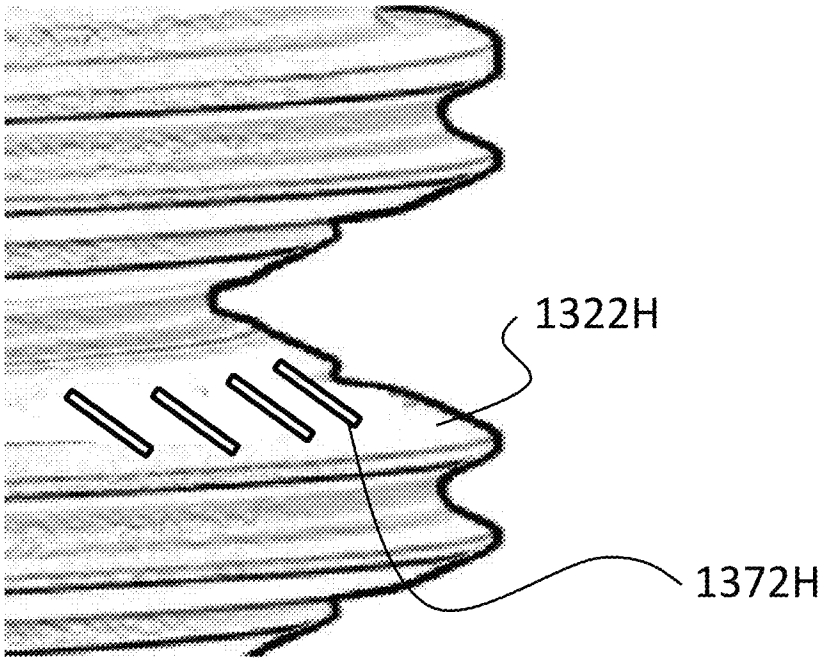
Figure 13I:
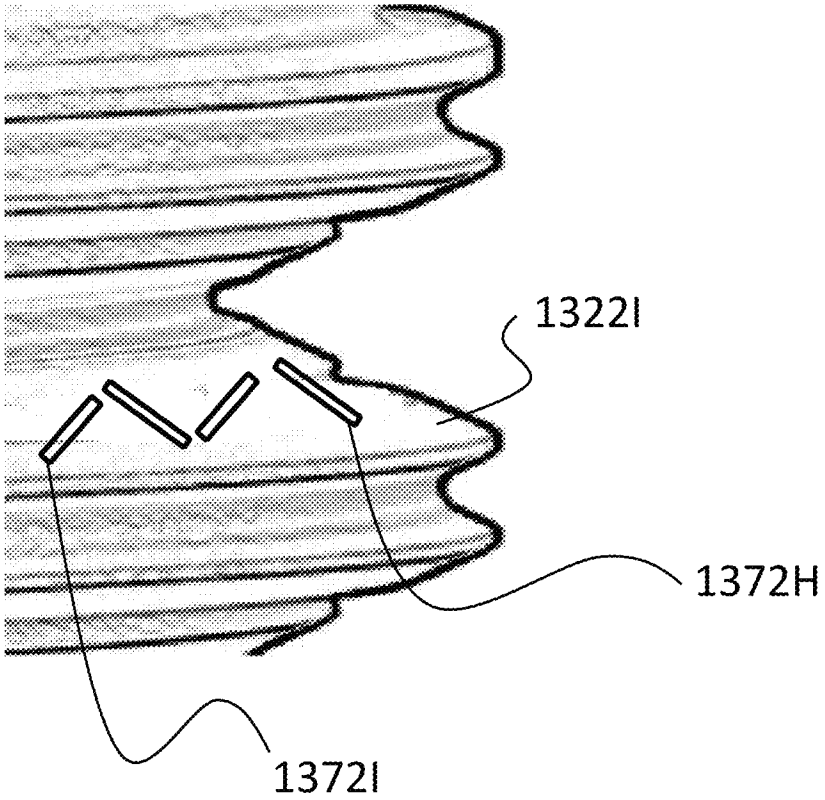
Figure 13J:
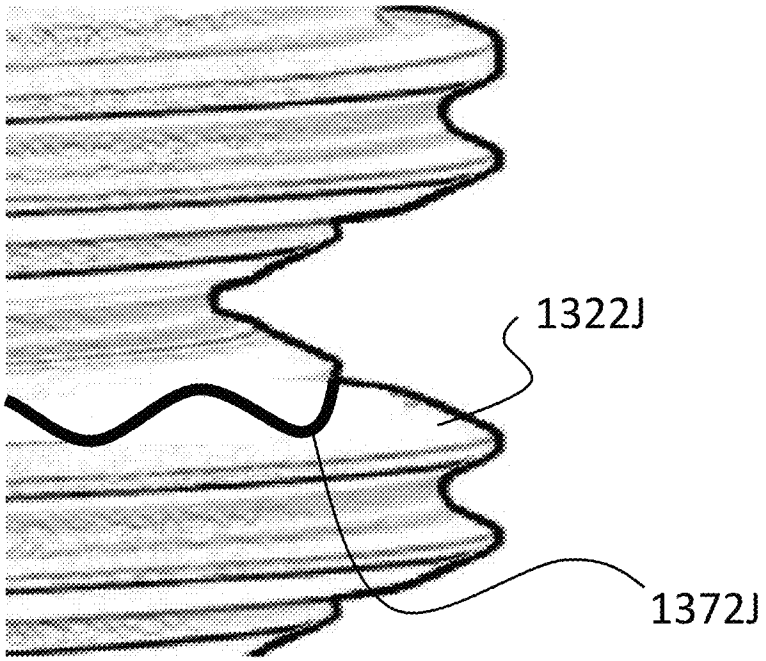

In this regard. FIG. 13G depicts an exemplary thread section 1322G having wave form elements 1372G arrayed on the face of the thread. FIG. 13H depicts an alternate embodiment having a thread section 1322H having linear elements 1372H arrayed on the face of the thread. As noted above, the linear elements 1372H can have a longitudinal axis lying on the plane that extends through and is parallel to the longitudinal axis of the bone fixture (e.g., the elements can be arranged in a spline form). FIG. 13I depicts an alternate embodiment having a thread section 1322I having linear elements 1372H and 1372I arrayed on the face of the thread, except that the elements are located at different angles relative to one another. In some embodiments (as with all embodiments unless otherwise indicated, the elements can overlap one another). FIG. 13J depicts an alternate embodiment having a thread section 1322J having an element 1372J that is in a wave form as it extends about the bone fixture.

Figure 13K:
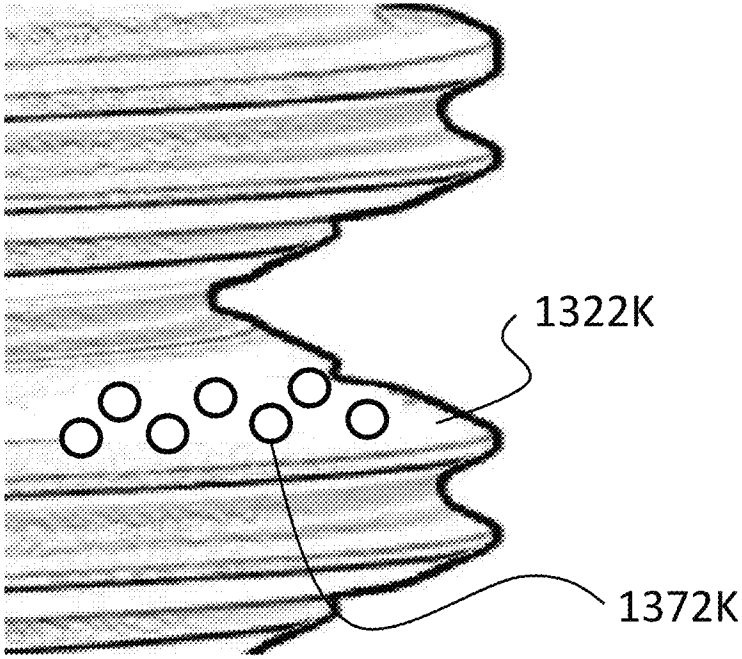

FIG. 13K depicts an alternate embodiment having elements 1372K located on the face of the thread section 1322K. On an exemplary embodiment, the elements 1372K are hemispherical indentations in the surface, where the outer diameter is about 50 to about 200 nanometers, and the depth is about 70 to about 250 nanometers.

The elements of the FIGS. 13A-13K can correspond to the grooves and/or microstructures detailed herein and/or variations thereof. It is further noted that while the elements are detailed only on one face of the thread, in alternate embodiments, the elements can be located on both faces.

It is further noted that the elements of FIGS. 13A-13K and/or the grooves and/or microstructures detailed herein and/or variations thereof can have a width that varies. That is, for example, in the case of a groove, the width of the groove can widen and narrow along the longitudinal axis thereof.

Some exemplary embodiments associated with the threaded section of the bone fixture 310 will now be described.

Figure 14:
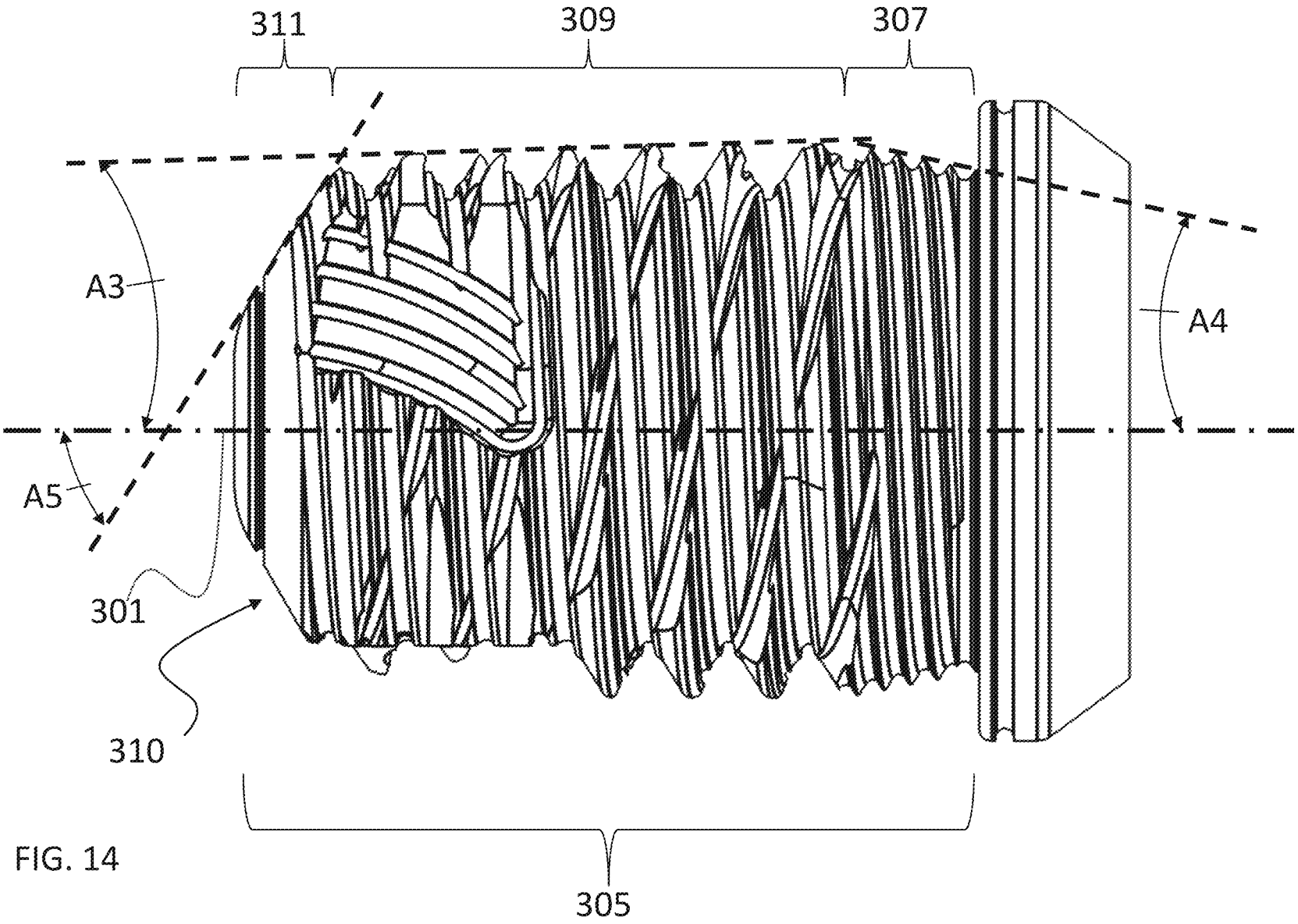
FIG. 14 duplicates the structure of FIG. 3A, but provides different graphics than that of 3A.

Referring now to FIG. 14, which duplicates the structure of FIG. 3A without certain reference numbers in the interests of clarity, it can be seen that the threaded section 305 of the bone fixture 310 includes an outer profile that is non-uniform. For example, FIG. 14 depicts a first sub-section 309 that has a taper relative to the longitudinal axis 301. In the embodiment of FIG. 14, sub-section 309 extends from the beginning of the full diameter thread to the end of the full diameter thread as shown. That said, in an alternate embodiment, section 309 can extend partially from the beginning of the full diameter thread or partially from the end of the full diameter thread. Still further in an exemplary embodiment, section 309 can begin and end in between the beginning and the end of the full diameter threads.

Section 309 is configured such that the crests of the thread of that section taper at an angle A3 relative to the longitudinal axis 301 with location along the longitudinal axis 301. With respect to the embodiment depicted in FIG. 14, the taper is a descending taper with location towards the distal end of the bone fixture 310. That is, the outer diameters located on planes normal to the longitudinal axis 301 established by the crests of the thread decrease with location along the longitudinal axis 301 towards the distal end of the bone fixture 310. Conversely, FIG. 14 depicts a second sub-section 307 that also has a taper relative to the longitudinal axis 301. In an exemplary embodiment, the tapering of sub-section 307 can be referred to as a back taper.

In particular, sub-section 307 is configured such that the crests of the thread of that section tapers at an angle A4 relative to the longitudinal axis 301 with location along the longitudinal axis 301. In an exemplary embodiment, angles A 3 and A4 can be an angle from about 1 degree to about 45 degrees (and they can be different angles, as can be seen in FIG. 14). In an exemplary embodiment angles A3 and A4 can be 1 degrees, 5, 10, 15, 20, 25, 30, 35, 40 or 45 degrees or any value or range of values therebetween in 1 degree increments (e.g., 1 to 30 degrees, 23 degrees, etc.). With respect to the embodiment depicted in FIG. 14, the taper is an ascending taper with location towards the distal end of the bone fixture 310. That is, the outer diameters located on planes normal to the longitudinal axis 301 established by the crests of the thread increase with location along the longitudinal axis 301 towards the distal end of the bone fixture 310. Accordingly, in an exemplary embodiment, there is a bone fixture 310 having a threaded section 305, wherein a first sub-section 307 of the threaded section 309 is tapered in an opposite direction from a second sub-section 309 of the thread section.

It is noted above that the tapering of sub-section 309 has been presented in terms of an angle relative to the longitudinal axis 301. In an alternative embodiment, the tapering can be described in terms of the difference in the outer diameters at the thread crest as measured on planes normal to the longitudinal axis 301 with location along the longitudinal axis 301. An exemplary embodiment, this difference can be between 0.05 mm to 1.5 mm or any value or range of values therebetween in 0.01 mm increments (e.g., 0.05 mm to 1 mm, 0.77 mm, etc.).

That said, in some alternate embodiments, the threaded section 305 may have only one sub-section that is tapered relative to the longitudinal axis 301. By way of example only and not by way of limitation, with respect to the embodiment of FIG. 14, sub-section 307 can be a section of uniform thread (i.e. non-tapered thread) and sub-section 309 can be a section of tapered thread (or vice versa). Also, in some embodiments, the entire section 305 can be tapered in one direction (either ascending and/or descending with location along the longitudinal axis 301). Furthermore, while the embodiment of FIG. 14 is depicted such that the sub-section closest to the flange 316 tapers in an ascending direction and the sub-section away from the flange 316 tapers in a descending direction, in alternative embodiments, the direction of taper can be the opposite from that depicted in FIG. 14. Any arrangement of tapering that can have utilitarian value can utilized in at least some exemplary embodiments. In this regard, by way of example only and not by way of limitation, in an exemplary embodiment, the back taper of sub-section 307 can have utilitarian value in that it can enhance or otherwise effectively preserve the bone from degrading over time after the implantation of the bone fixture 310 into the skull (i.e. six months, one year, two years, three years, four years, five years, 10 years or more after implantation), at least relative to a similarly situated implants without the back taper.

Also, some embodiments, the threaded section 305 can have more than two sub-sections having different tapering. Again with reference to FIG. 14, as can be seen, section 305 includes sub-section 311. Sub-section 311 has a taper that descends with location along the longitudinal axis 301 in the distal direction. Also, as can be seen, the angle of the tapering A5 is greater than that of angle A3 of section 309, which also has a descending taper with location along the longitudinal axis 301. In an alternative embodiment, the tapering of sub-section 307 could also descend with location along the longitudinal axis 301 in the distal direction. Accordingly, in an exemplary embodiment, there is a bone fixture 310 that has three sub-sections of the threaded section, each sub-sections having different tapering than that of the others. Still further, in an exemplary embodiment, a first of the sub-sections of the threaded section is tapered in an opposite direction from that of a second of the other of the sub-sections of the threaded sections. The first sub-section can have an angle of taper relative to the longitudinal axis of the bone fixture that is greater than that of a third sub-section, where the third sub-section has tapering in the same direction as the first sub-section.

In an exemplary embodiment, the angle A5 is between about 30 degrees and 70 degrees. In an exemplary embodiment, angle A5 can be 30 degrees, 35, 40, 45, 50, 55, 60, 65 or 70 degrees or any value or range of values therebetween in about 1 degree increments (e.g., 40 to 60 degrees, 42-58 degrees, 51 degrees, etc.). In an exemplary embodiment, the drill angle is between about 90 degrees and 140 degrees or any value or range of values therebetween in about 1 degree increments (e.g., 100 to 130 degrees, 115 degrees, 118 degrees, etc.) In an exemplary embodiment, the angle A5 corresponds to the angle of the drill utilized to drill the hole into the skull into which the bone fixture is fixed. In an exemplary embodiment, the corresponding angles are the same and/or about the same and/or within 5, 10, 15 or 20 degrees of each other or any value or range of values therebetween in 1 increments.

Accordingly, in an exemplary embodiment, there is a method including the action of drilling a hole into the skull utilizing a drill bit having a drill bit tip angle, followed by the action of inserting a bone fixture into the drill hole where the angle of taper of the sub-section at the distal end of the bone fixture (i.e. section 309 with respect to FIG. 14) is the same or about the same as the angle of the drill bit tip angle. In an exemplary embodiment, the aforementioned sub-section at the distal end of the bone fixture is referred to as the apical tip of the bone fixture.

Again referring to FIG. 14, it can be seen that the thread of section 307 is different from the thread of section 309. More particularly, the thread of section 309 has frequently been referred to herein as a "full thread." The bone fixture 310 also includes a minor thread. This minor thread is located in sub-section 307 as can be seen in FIG. 14. In the exemplary embodiment of FIG. 14, the depth and pitch of the thread of sub-section 307 is substantially different than that of the full thread of sub-section 309. That said, in an alternate embodiment, only the thread or only the pitch is different from that of the full thread of sub-section 309. Any configuration of the threads in sub-section 307 that can enable the teachings detailed herein and/or variations thereof to be practiced can utilize in at least some embodiments.

Figure 15:
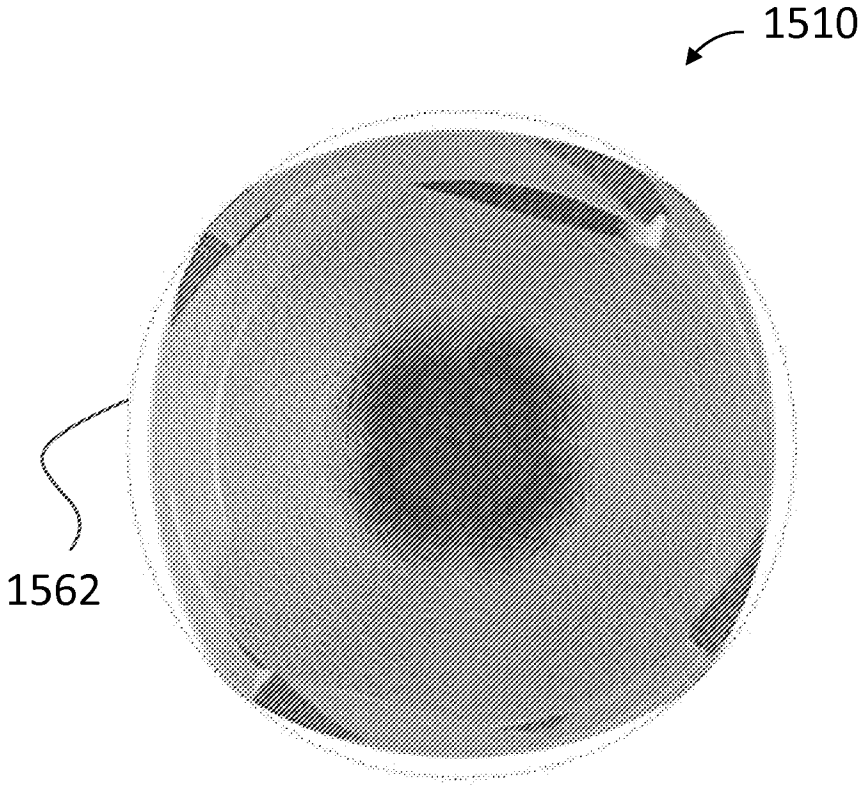
FIG. 15 depicts an alternate embodiment of a bone fixture.

Referring now to FIG. 15, which depicts a view of an alternate embodiment of the bone fixture 1510 (where the flange is not shown for clarity) when viewed from the distal end (i.e. looking towards the flange 316 if it were present in FIG. 15). In the embodiment of bone fixture 1510, the outer profile of the threaded section is non-uniform in that the outer circumference of the thread section is non-circular. More particularly, FIG. 15 depicts a conceptual perfect circle 1562 extending about and concentric with the longitudinal axis (not shown) of the bone fixture 1510. If the outer circumference of the thread section of bone fixture 1510 was circular, the thread section would and substantially at the perfect circle 1562. However, as can be seen, only some portions of the thread section of the bone fixture 1510 extended to the perfect circle 1562. In this regard, as can be seen, the thread section extends to the perfect circle 1562 at four locations that are equally spaced about the longitudinal axis of the bone fixture 1510. In between those four locations, the thread section does not expand to the perfect circle 1526. Instead, the thread sections extend in a parabolic/elliptical manner from the portions that extends the perfect circle 1562.

Figure 16A:
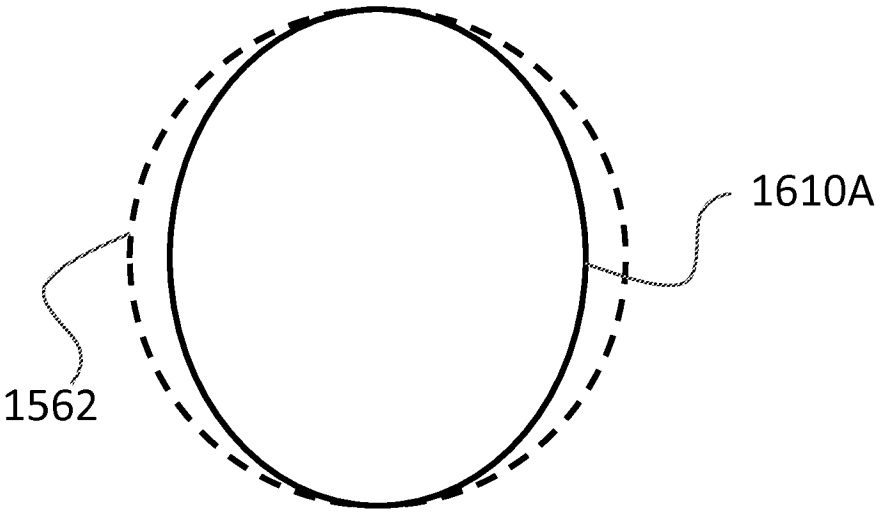
FIGS. 16A-16C depict conceptual alternate embodiments of the alternate embodiment of FIG. 15.

Accordingly, in an exemplary embodiment, the body of the bone fixture/threaded section of the bone fixture is not completely round/is non-circular. In an exemplary embodiment, the body can have an ellipse shape (i.e., a cross-section lying on the plane normal to the longitudinal axis of the bone fixture), as seen in FIG. 16A with respect to bone fixture 1610A. Thus, in an exemplary embodiment, there is an outer profile of the threaded section that has an outer circumference about a longitudinal axis of the bone fixture that includes at least two different radiuses of curvature.

Figure 16B:
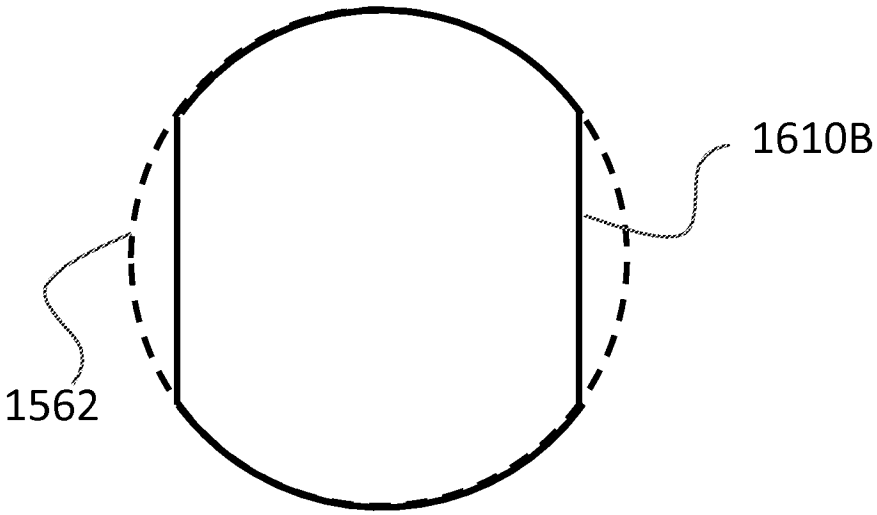
Figure 16C:
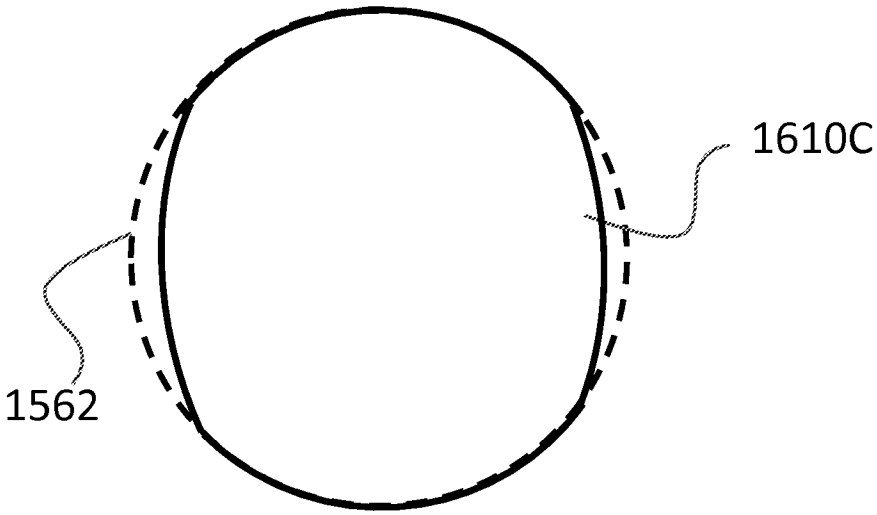

Alternatively and/or in addition to this, sides of the threaded section can be flats or curved (the side can be faceted for example), as can be seen in FIGS. 16B and 16C with respect to bone fixtures 1610B and 1610C, respectively. In some exemplary embodiments, the sides of the threaded section can have a partially circle section and a partially faceted section (with two or more facets which can be equally spaced about the longitudinal axis, or can be unequally spaced about the longitudinal axis).

In an exemplary embodiment, the mean average distance of the crests of the thread of the threaded section of the bone fixture from the perfect circle is about 0.01 to about 1.5 mm or any value or range of values therebetween in about 0.01 mm increments (e.g., about 0.1 mm to about 1.0 mm, 0.79 mm, etc.).

In an exemplary embodiment of a bone fixture having a threaded section that is non-circular, there can be utilitarian value of such vis-à-vis implant stability. By way of example only and not by way of limitation, in an exemplary embodiment, the spaces afforded by the non-circular geometry (i.e. the space between the body of the bone fixture and the conceptual perfect circle provide space for bone chips between the drilled hole in the bone fixture). Alternatively and/or in addition to this, in an exemplary embodiment, the non-circular configuration can result in an implant that is more robustly implanted in the skull. For example, in an exemplary embodiment, the non-circular configuration can result in an implant that requires a higher removal torque than that which would be the case for a bone fixture having a circular configuration, all other things being equal.

Referring back to FIG. 3A, as can be seen, bone fixture 310 includes thread 315, and thread 315 has a handed direction of a right hand thread. As noted above, thread 315 is a full thread. Still with reference to FIG. 3A, as can be seen, there is a helical groove 362 that extends about the longitudinal axis of the bone fixture 310 having a handed direction opposite to that of the thread 315 (as well as that of the minor threads adjacent surface 350). In an exemplary embodiment, the helical groove 362 has a configuration according to any one or more of the grooves detailed herein. Indeed, in an exemplary embodiment (such as the embodiment of FIG. 3A), there are two helical grooves extending about the longitudinal axis 301. In this regard, the embodiment of FIG. 3A is a double threaded helically grooved bone fixture. In another exemplary embodiments, there are three or more helical grooves extending about the longitudinal axis 301. Any number of helical grooves that can enable the teachings detailed herein and/or otherwise can have utilitarian value can utilized in at least some embodiments. In this regard, in an exemplary embodiment, the helical groove 362 forms at least one spiral cutting edge on the thread 315. In an exemplary embodiment, the helical groove 362 forms a plurality of spiral cutting edges on the thread 315. In an exemplary embodiment, the plurality is established by the fact that the groove is not contiguous about the body of the bone fixture due to the "valleys" of the thread 315, at least in embodiments where the pitch of the helical groove 362 such that it extends in a longitudinal direction such that it spans the "valleys" and/or at least in the embodiments where the helical groove 362 extends a sufficient distance in the longitudinal direction. With regard to the latter, it is noted that while the embodiment of FIG. 3A depicts a helical groove 362 that extends a substantial length along with the threaded section of the bone fixture, and in other embodiments, the helical groove extends only a fraction of that distance. In an exemplary embodiment, these spiral cutting edges on the thread 315 can result in a reduction of the torque that is required to insert the bone fixture into the hole into the skull as compared to that which would be the case in the absence of the helical grooves (and thus the spiral cutting edges), all other things being equal.

Figure 17:
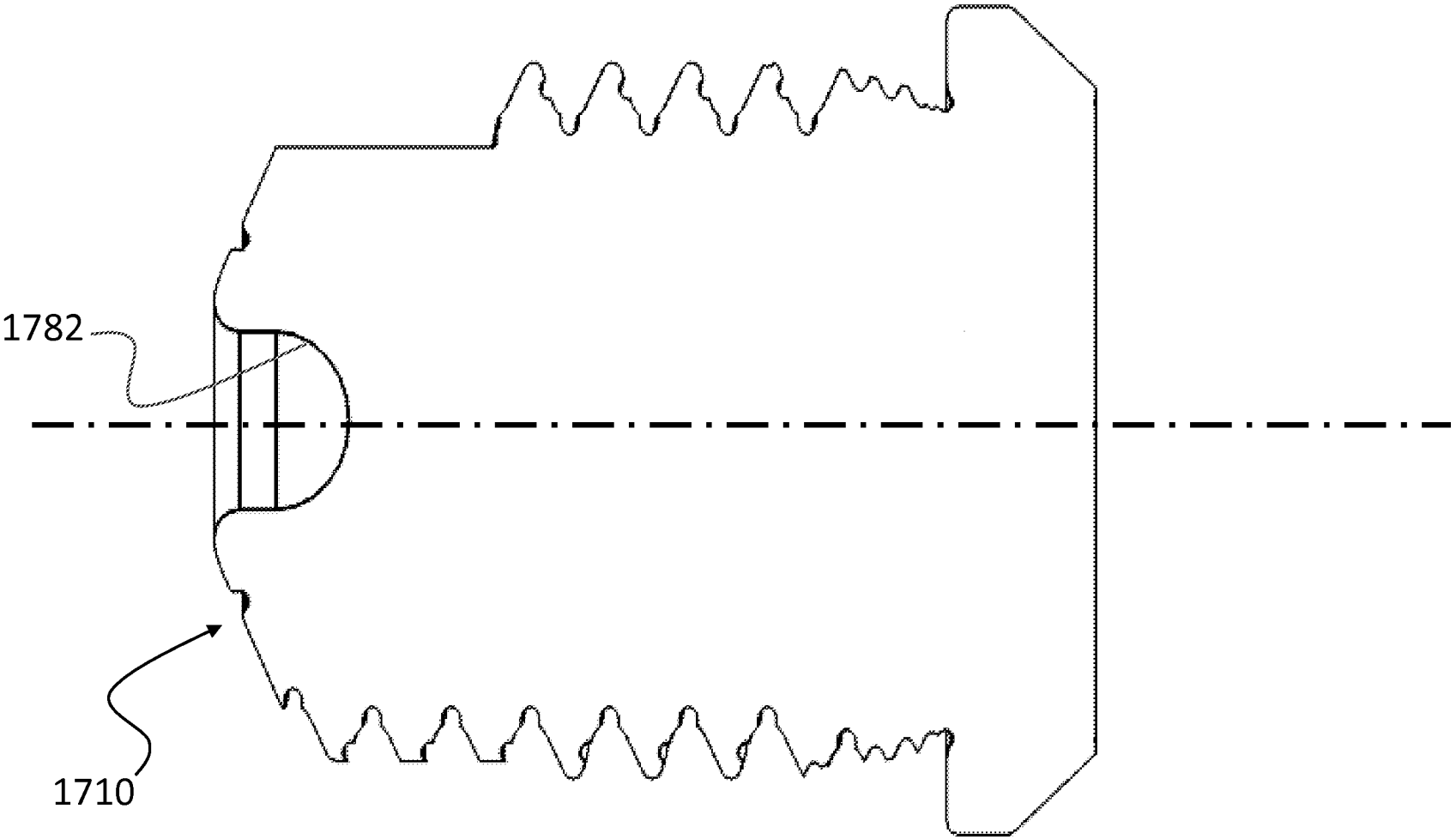
FIG. 17 depicts an alternate embodiment of a bone fixture.

As noted above, the distal end of the bone fixture 310 can include a conical tip (e.g., the portion of section 311). Alternatively and/or in addition to this, the tip of the bone fixture can have a hollow portion open to an outside of the bone fixture. In this regard, referring now to FIG. 17, there is a bone fixture 1710 that includes a hollow portion 1782 as can be seen. In an exemplary embodiment, the hollow 1782 enhances bone growth therein, further securing the bone fixture 1782 to the bone of the recipient.

Some additional exemplary features of at least some embodiments of some bone fixtures will now be described.

Referring back to FIG. 14, it is noted that threaded section 305 corresponds to the section of the bone fixture 310 that extends beneath the surface of the skull (or, more accurately, the extrapolated surface of the skull that was present prior to the drilling a hole in the skull). In an exemplary embodiment, the length of section 305 is from about 1 mm to about 15 mm or any value or range of values therebetween in about 0.1 mm increments (e.g. about 2 mm to about 12 mm, about 3 mm, about 4 mm, about 5 mm, about 6 mm, etc.). It is further noted that the mean average out a diameter of the full thread 315 can be between about 3 mm to about 7 mm in diameter (as measured on a plane normal to the longitudinal axis 301 of the bone fixture) or any value or range of values therebetween in about 0.1 mm increments (e.g., about 4 mm to about 6 mm, 3.5 mm, 4.6 mm, 5 mm, etc.). With respect to the height of the flange 316 (i.e. the distance from the bottom surface 350 to the top/proximate surface of the bone fixture 310) this I can be about 0.5 mm to about 5 mm or any value or range of values therebetween in about 0.1 mm increments (e.g. about 1 mm to about 4 mm, 2.8 mm etc.).

In at least some exemplary embodiments, the bone fixture 310 is a monolithic structure made of commercially pure titanium or titanium-alloy. This includes at least some embodiments having the scaffold structure detailed above and/or the micro surface structure detailed above. That is, the monolithic structure of the bone fixture 310 includes the scaffolds and/or microstructure noted above.

In an exemplary embodiment, surface roughness of at least some components of the bone fixture 310, such as by way of example only and not by way of limitation, the full thread, can be a relatively smooth machine surface with a typical roughness value $R_a$ (arithmetic roughness) between about 0.3 to about 0.9 μm ($S_a$=0.3 to 0.9 micrometers) or any value or range of values therebetween in about 0.01 μm increments. Alternatively and/or in addition to this, some surfaces can be a medium rough surface obtained by for example, grit blasting acid etching, electromechanical working, and/or laser modification, etc.). In some exemplary embodiments, these medium rough surfaces can have a roughness value $R_a$ between about 0.9 μm to about 2.0 μm or any value or range of values therebetween in about 0.01 μm increments. Alternatively and/or in addition to this, some surfaces can be a rough surface which can have a $R_a$ value between about 2.0 to 25 μm, or any value or range of values therebetween in about 0.01 μm increments. In an exemplary embodiment, such rough surfaces can be obtained by, for example, grit blasting, plasma-spraying or acid etching, and/or a three dimensional trabecular mesh established thereon by, for example, additive manufacturing, etc. Still further, in an exemplary embodiment, some or all services are treated with hydroozxyapatite or an equivalent coating having a thickness from about 5 nm to about 40 μm or any value or range of values therebetween. In some embodiments, any surface, such as a modified surface, that promotes osseointegration, and/or enables faster and stronger bone formation, better stability during the healing process, and/or improved clinical performance in poor bone quality and quantity, relative to that which would be the case in the absence of such surface, can be utilized in at least some embodiments.

It is again reiterated that in at least some embodiments, any one or more of the teachings detailed herein can be combined with any other one or more teachings detailed herein.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An apparatus for a bone conduction implant, comprising:

a bone fixture including a threaded section, wherein an outer profile of the threaded section is non-uniform, wherein the threaded section includes a thread, and, over substantially all of the thread, a crest of the thread is different from a uniform curved truncated crest, and the threaded section extends a first distance in a direction of the longitudinal axis of the fixture, wherein the fixture, in its entirety, extends a distance in a direction of the longitudinal axis that is between 1.25 and 1.375 times the first distance, wherein the maximum diameter of the thread is greater than the first distance.

2. An apparatus for a bone conduction implant, comprising:

a bone fixture including a threaded section, wherein an outer profile of the threaded section is non-uniform, wherein the threaded section includes a thread, and, over substantially all of the thread, a crest of the thread is different from a uniform curved truncated crest, and the fixture includes a flange, the diameter of which exceeds a maximum diameter of the thread by 10% to 20%, the diameter being normal to the longitudinal axis.

3. An apparatus for a bone conduction implant, comprising:

a bone fixture including a threaded section, wherein an outer profile of the threaded section is non-uniform, wherein the threaded section includes a thread, and, over substantially all of the thread, a crest of the thread is different from a uniform curved truncated crest, and the threaded section extends a distance in a direction of the longitudinal axis of the fixture that is between 3.8 and 4.2 mm, wherein the fixture, in its entirety, extends a distance in a direction of the longitudinal axis between 5.1 and 5.5 mm, wherein the maximum diameter of the thread is between 4.3 mm and 4.7 mm.

4. The apparatus of claim 3, wherein:

the fixture includes a flange, the diameter of which exceeds a maximum diameter of the thread by 10% to 20%, the diameter being normal to the longitudinal axis of the fixture.

5. An apparatus for a bone conduction implant, comprising:

a bone fixture including a threaded section, wherein an outer profile of the threaded section is non-uniform, wherein the threaded section includes a thread, and, over substantially all of the thread, a crest of the thread is different from a uniform curved truncated crest, and the outer circumference of all of the thread of the fixture is within a perfect circle, a mean average distance of the crests of the thread of the threaded section of the bone fixture from the perfect circle is about 0.01 to about 1.5 mm.

6. An apparatus for a bone conduction implant, comprising:

a bone fixture including a threaded section, wherein an outer profile of the threaded section is non-uniform, wherein the threaded section includes a thread, and, over substantially all of the thread, a crest of the thread is different from a uniform curved truncated crest, and the threaded section extends a distance in a direction of the longitudinal axis of the fixture that is 4 mm, wherein the fixture, in its entirety, extends a distance in a direction of the longitudinal axis that is 5.3 mm, wherein the maximum diameter of the thread is 4.5 mm.

7. An apparatus for a bone conduction implant, comprising:

a bone fixture including a screw thread configured to screw into a skull, wherein at least a portion of a section of the screw thread is non-uniform; and at least one cutting pocket extending across a plurality of thread crests relative to a longitudinal axis of the bone fixture, wherein the at least one cutting pocket includes at least one structural surface feature configured to promote growth of the recipient's skull bone, wherein the threaded section extends a distance in a direction of the longitudinal axis of the fixture that is between 3.8 and 4.2 mm, wherein the fixture, in its entirety, extends a distance in a direction of the longitudinal axis between 5.1 and 5.5 mm, wherein the maximum diameter of the thread is between 4.3 mm and 4.7 mm, and wherein the fixture includes a flange, the diameter of which exceeds a maximum diameter of the thread by 10% to 20%, the diameter being normal to the longitudinal axis of the fixture.

8. An apparatus for a bone conduction implant, comprising:

a bone fixture including a screw thread configured to screw into a skull, wherein at least a portion of a section of the screw thread is non-uniform; and at least one cutting pocket extending across a plurality of thread crests relative to a longitudinal axis of the bone fixture, wherein the at least one cutting pocket includes at least one structural surface feature configured to promote growth of the recipient's skull bone, wherein the fixture includes a flange, the diameter of which exceeds a maximum diameter of the thread by 10% to 20%, the diameter being normal to the longitudinal axis of the fixture, wherein there is a groove located on a bottom surface of the flange, the bottom surface facing the thread.

9. An apparatus for a bone conduction implant, comprising:

a bone fixture including a screw thread configured to screw into a skull, wherein at least a portion of a section of the screw thread is non-uniform; and at least one cutting pocket extending across a plurality of thread crests relative to a longitudinal axis of the bone fixture, wherein the at least one cutting pocket includes at least one structural surface feature configured to promote growth of the recipient's skull bone, wherein the fixture includes a flange, the diameter of which exceeds a maximum diameter of the thread by 10% to 20%, the diameter being normal to the longitudinal axis of the fixture, wherein an outer circumference of the flange establishes a cylindrical body that extends parallel to a longitudinal axis of the fixture.

10. An apparatus for a bone conduction implant, comprising:

a bone fixture including a screw thread configured to screw into a skull, wherein at least a portion of a section of the screw thread is non-uniform; and at least one cutting pocket extending across a plurality of thread crests relative to a longitudinal axis of the bone fixture, wherein the at least one cutting pocket includes at least one structural surface feature configured to promote growth of the recipient's skull bone, wherein the fixture includes a flange, the diameter of which exceeds a maximum diameter of the thread by 10% to 20%, the diameter being normal to the longitudinal axis of the fixture, wherein there is only one groove located on a bottom surface of the flange, the bottom surface facing the thread.

* * * * *